US007553216B2

(12) United States Patent
Hyde et al.

(10) Patent No.: US 7,553,216 B2
(45) Date of Patent: Jun. 30, 2009

(54) HONING GUIDE ASSEMBLY

(75) Inventors: Brent K. Hyde, Ottawa (CA); Steven K. Jones, Ottawa (CA); Robin C. Lee, Nepean (CA); Scott T. Roger, Ottawa (CA); Terry R. Saunders, North Gower (CA); Matthew B. Siemers, Ottawa (CA)

(73) Assignee: Lee Valley Tools, Ltd., Ottawa, Ontario (CA)

( * ) Notice: Subject to any disclaimer, the term of this patent is extended or adjusted under 35 U.S.C. 154(b) by 254 days.

(21) Appl. No.: 10/553,592

(22) PCT Filed: Apr. 16, 2004

(86) PCT No.: PCT/IB2004/001152

§ 371 (c)(1),
(2), (4) Date: Oct. 17, 2005

(87) PCT Pub. No.: WO2004/091860

PCT Pub. Date: Oct. 28, 2004

(65) Prior Publication Data

US 2006/0211348 A1 Sep. 21, 2006

Related U.S. Application Data

(60) Provisional application No. 60/463,484, filed on Apr. 17, 2003, provisional application No. 60/509,599, filed on Oct. 8, 2003.

(51) Int. Cl.
*B24B 3/38* (2006.01)

(52) U.S. Cl. ..... 451/45; 451/371

(58) Field of Classification Search ..... 451/386, 451/391, 378, 371, 370, 367, 45
See application file for complete search history.

(56) References Cited

U.S. PATENT DOCUMENTS 166,830 A 8/1875 Weaver (Continued)

FOREIGN PATENT DOCUMENTS

DE 526 996 C 6/1931

(Continued)

OTHER PUBLICATIONS

Multifilla: Complete Art & Craft Materials Supply Warehouse: Product Highlight: Item 37—Universal Honing Guide, http://www.multifilla.com/new_page_17.htm, printed off the internet on Dec. 2, 2002.

(Continued)

*Primary Examiner*—Robert Rose
(74) *Attorney, Agent, or Firm*—Kilpatrick Stockton LLP; John S. Pratt; Camilla C. Williams

(57) ABSTRACT

A honing guide and bevel setting jig for removable attachment to the honing guide to properly position the angle and projection of a tool to be sharpened in the jig to enable the tool to be honed at the proper angle and position. An adjustable roller that contacts an abrasive surface during use of the guide facilitates formation of micro bevels. A tool securing bar having a generally triangular shape in the bar's middle section forces the arris-defining back of the tool being honed against a reference surface in the guide by tightening thumb nuts around threaded studs projecting from the bar. Jigs for use with both square and skew edge chisel and blades are described. A concave surface clamp bar honing guide provides enhanced gripping of the tool being honed, and wedges and adjustable structures expand the range of bevel angles that can be honed.

31 Claims, 20 Drawing Sheets

U.S. PATENT DOCUMENTS

| | | | | | |
|---|---|---|---|---|---|
| 210,957 | A | | 12/1878 | Olsen | |
| 364,353 | A | | 6/1887 | Kampfe | |
| 418,781 | A | | 1/1890 | Blakeslee | |
| 449,673 | A | | 4/1891 | Francis | |
| 560,111 | A | * | 5/1896 | Salot | 451/370 |
| 729,319 | A | | 5/1903 | Fowler | |
| 1,239,494 | A | | 9/1917 | Lange | |
| 1,498,283 | A | * | 6/1924 | Kelsey | 451/370 |
| 1,770,538 | A | | 7/1930 | Warner | |
| 2,353,096 | A | | 7/1944 | Weidauer | |
| 2,740,241 | A | * | 4/1956 | McCubbin | 451/371 |
| 3,950,899 | A | * | 4/1976 | Gilbert | 451/370 |
| 4,078,781 | A | * | 3/1978 | Fraser et al. | 269/171 |
| 4,733,501 | A | * | 3/1988 | McLean | 451/380 |

FOREIGN PATENT DOCUMENTS

| | | | |
|---|---|---|---|
| FR | 1205686 | | 6/1958 |
| GB | 215818 | | 11/1923 |
| GB | 626372 | | 5/1947 |
| GB | 693863 | | 7/1953 |
| GB | 795157 | | 5/1958 |
| GB | 911900 | | 9/1961 |
| GB | 924579 | | 4/1963 |
| GB | 326370 | | 10/2007 |
| JP | 10-44001 | * | 2/1998 |

OTHER PUBLICATIONS

Product Details for Item No. 14-050, "1/8" to 2-3/8 "Blade Fine Woodworking Honing Guide", Stanley Hand Tools, www.stanleytools.com/default.asp?TYPE=PRODUCT &PARTNUMBER=14-050&PAGE=PRINT, printed off the internet on Oct. 13, 2005.

Leonard Lee, *The Complete Guide to Sharpening*, p. 62—"Honing Guides", The Taunton Press, Newtown, CT (1995).

David Charlesworth, "Honed to Perfection," *Furniture and Cabinet Making,* No. 69 (Oct. 2002).

Instruction Sheet for Stanley Tools honing guide (described in U.S. Patent No. 3,950,899 cited above). Admitted Prior Art.

Three pictures of Stanley Tools honing guide. Admitted Prior Art.

Photograph of Eclipse honing guide (as described in GB Patent No. 924579 cited above). Admitted Prior Art.

Stanley Honing Guide, http://us.st7.yimg.com/store4.yimg.com/I/toolsplus_1732_2818531, printed Apr. 11, 2003.

"Stanley Honing Guide," http://www.garrettwade.com/, item No. 23M01.01, printed Dec. 2, 2002.

Veritas Honging Guide and Bevel Setter, http://www.garrettwade.com/, item Nos. 80J01.01, 80J01.02, 80J01.03, printed Dec. 2, 2002.

"Fasttrak Tool Holder Honing Guide," http://www.garrettwade.com/, item Nos. 35S02.01 35S02.02, printed Dec. 2, 2002.

"Side Clamp Honing Guide," http://www.garrettwade.com/, item No. 10M07.01, printed Dec. 2, 2002.

"British-made Chisel Honing Guide," http://www.garrettwade.com/, item No. 62J02.12, printed Dec. 2, 2002.

http://www.leevalley.com/images/item/woodworking/sharpening/60m0701s1.jpg, printed Dec. 2, 2002.

"Sharpening System Instruction Manual," Woodworking Fasttrak, Inc. (2000).

Items A-G, Garrett Wade Tool Catalog, vol. 29, No. 6 (Nov. 2002).

Page 44 and 45, Garrett Wade Tool Catalog, vol. 29, No. 1 (Jan. 2002).

* cited by examiner

HONING GUIDE ASSEMBLY

CROSS-REFERENCE TO RELATED APPLICATIONS

This application claims priority to U.S. Provisional Patent Application Ser. No. 60/463,484 filed Apr. 17, 2003 entitled "Honing Guide Assembly," and U.S. Provisional Application Ser. No. 60/509,599 filed Oct. 8, 2003 entitled "Honing Guide Concave Surface Clamp Bar," each of which is in incorporated herein by reference.

FIELD OF THE INVENTION

This invention relates to honing and sharpening guides used for holding chisels, plane blades and other edge tools and tool blades while grinding, sharpening and honing the tools and blades.

BACKGROUND Of THE INVENTION

Honing guides have long been available for holding chisels and plane blades at a predetermined angle relative to a planar abrasive surface, such as the surface of a sharpening stone or a sheet abrasive material affixed to a flat surface such as plate glass. Such commercially available guides generally have wheels or a wide roller that rolls over the abrasive surface or another parallel reference surface and a means for fixing the chisel or plane blade to the guide during use. Some of the prior art guides engage the sides of the chisel or plane blade in a clamping arrangement, and other of the prior guides use a clamping screw to apply force to one face of the chisel or plane blade to force it against guide structure in contact with the other face of the chisel or plane blade.

It is well known in the prior art that a sharp edge can be created more quickly by forming a first bevel on a plane blade or a chisel with a relatively coarse, fast cutting abrasive and then using a finer abrasive, which is therefore slower cutting, to form a micro bevel immediately adjacent to the cutting edge or arris of the blade or chisel at a slightly steeper angle than the principal bevel. This can be accomplished, for instance, by putting a shim under the wheels or roller associated with the honing guide (where the guide separates the roller a substantial distance from the blade bevel) or by adjusting the position of the axis of rotation of the wheels or rollers to slightly lift the guide as taught by U.S. Pat. No. 4,733,501.

While prior honing guides are very useful tools, several aspects of the functionality of these jigs can be improved.

For instance, recent reintroduction of manufacture of number 8 jointer bench planes creates a need for honing jigs able to accommodate the 2-⅝ inch wide plane blades of such planes, and many currently available honing guides cannot accept blades of that width.

It is also desirable to provide enhanced ability to select bevel angles within the range of such angles typically used, approximately 20 degrees to 40 degrees. It is also desirable to properly locate the entire cutting edge or arris relative to the guide, because some prior guides make it easy for the arris to be located out of square with the guide.

It is desirable to make the honing guide and its blade bevel setting functionality useable with skew chisels.

Many prior art honing guides secure the chisel or plane blade in the guide by reference to the longitudinal tool face surface adjacent to the bevel. This happens, for instance, in a guide where a bench chisel is positioned bevel down and a thumbscrew above the chisel presses against the back face or underside of the chisel, forcing the opposite, top side of the chisel against a guide reference surface. The cutting arris on such a chisel is defined, however, by the intersection of the bevel with the back face of the chisel, against which the thumbscrew presses. The way these prior art honing guides secure the tool being honed is not a problem if the back face and the opposite, front face or top surface are parallel, but they often are not. Additionally, longitudinal bevels on the sides of relatively narrow bench chisels cause this top surface to be quite narrow, which introduces additional difficulty associated with use of it as a reference surface because the chisel may "rock" to one side or the other when it is being secured in the honing guide.

It is desirable to provide a honing guide with enhanced clamping to prevent the tool from skewing while the honing guide is in use. Most existing clamping devices use a single, large screw with a swiveling pad to hold the tool in position. No matter how much pressure is applied to clamp the tool, relatively little force is need to rotate the tool about the axis of the screw.

Another consideration associated with honing guides is the range of bevel angles that can be formed using the guide. Many guides provide a range of angles of approximately 20° to 40°, and it is sometimes desirable to be able to hone either smaller or larger angles.

SUMMARY OF THE INVENTION

The improved honing guide of this invention is an extremely versatile guide useable with a wide range of chisel and blade widths, thicknesses, lengths, and end configurations (square or skewed) to hone a wide range of bevel angles. Associated bevel-setting jigs that couple to the guide makes it easy and quick to position a tool or blade in the guide at a desired bevel angle with the cutting arris properly positioned parallel to the axis of rotation of a guide roller that contacts the planar abrasive surface during use of the guide. A clamping bar contacting the face of the tool or blade adjacent to the bevel securely presses against a reference surface in the guide a surface of the tool or blade that intersects the bevel to form the cutting edge or arris. This reference surface is parallel to the roller axis of rotation.

Consequently, when a plane blade or chisel is secured in the guide, a bevel will be formed that intersects the adjacent tool or blade surface to produce an arris parallel to the axis of rotation of the roller.

In order to minimize the amount of material that needs to be removed during a sharpening operation using the guide of this invention, it is desirable that that the existing arris be positioned parallel to the roller axis of rotation and a distance from that axis of rotation that results in a desired bevel angle. These objectives are achieved by providing a jig or gauge that is temporarily coupled to the honing guide and that has a stop locatable at desired distances from the guide to produce desired bevel angles. One such jig for square end tools provides a reference surface or fence to position a side of the blade or chisel square to the roller so that the bevels formed using the guide will be properly oriented square to the tool. A different positioning jig allows the user to exercise similar control over the positioning of the skew chisels in the jig. It attaches to the honing guide in the same manner, is fitted with an adjustable stop as well, and may include one or two reference fences to contact with the side of a skew chisel or blade.

The tool or blade holding structure of the guide projects beyond the guide roller toward the bevel and grasps the tool relatively near the bevel for better control and so that short tools and blades can be secured in the guide and sharpened.

The roller is positionable in at least two locations relative to the tool holder to facilitate formation on a tool of a primary bevel with the roller in one location and a micro bevel with the roller in a second position that slightly lifts the guide. This may be accomplished as taught in U.S. Pat. No. 4,733,501, which is incorporated herein by this reference. The roller may be moved between the two positions by moving the position of axle on which the roller rotates. The axle may be eccentrically positioned on a shaft that is spring loaded to hold a knob on the end of the shaft against a protrusion on one of the guide body or the knob and one of at least two detents in the other of the guide body or the knob. The knob is pulled axially to disengage the from the detent and rotated to engage another detent.

The honing guide of this invention may also be used as a grinding jig. Structure behind the roller, such as a protruding ledge, enables the guide to rest on a tool rest on a typical motorized bench grinder, belt grinder or other motorized abrasive device. This will allow the user to position a tool to be sharpened once in the guide for both rough grinding and fine honing. Although the guide may not necessarily enable closely controlled, or repeatable grinding angles, by resting the guide on a bench grinder tool rest, such control is not generally required because the angle at which a tool is ground will typically be 2° to 5° less then the honing angle. Such a slightly different grinding angle can typically be judged by eye with very little practice. As is described in detail at page 62 of Leonard Lee's book, *The Complete Guide to Sharpening*, which book is incorporated herein in its entirety by reference, grinding material from the heel of the bevel at a lower angle will allow much faster honing with less wear on the honing media. Performing both grinding and honing with the tool in the same position in the guide will ensure that the relief grind and the desired cutting arris are parallel—additionally reducing honing time.

The honing guide of this invention may also include concave surface clamp bars to improve the blade-holding ability of the assembly. The concave clamping surface of the clamp bar of this honing guide forces the separation of the regions of contact with the tool being honed and concentrates the clamping force along parallel lines.

The geometry of typical honing guides enables honing of bevel angles of approximately 20° to 40°. Although this meets the requirements for the vast majority of tools, some specialized woodworking techniques require an angle that is either very high (for example, 40° to 60°) or very low (for example, 5° to 20°).

The honing guide of this invention can accommodate such larger or smaller bevel angles using two alternative structures. The first of these is a pair of generally wedge-shaped spacers that that may be employed to shift the range of achievable bevel angles. These spacers allows two identical parts to be used together and with the honing guide to modify the opposed clamping surfaces through by 16° (or another appropriate similar angle) at each end of its range, thus adding a total of approximately 32° of range. Each spacer, when viewed in cross section, has a 16° included angle. Each spacer is equipped with a slot at one end and a half slot on the other end. This allows the user to place the slotted end against one clamp screw or stud and then pivot the spacer into position. The half-slotted end is fitted with a small leaf or other spring to ensure it will snap into place and remain in proper position without being held by the user. The pair of spacers is reversible in order to permit extension of each end of the range of angles that the honing guide is otherwise capable of achieving.

While slight relocation of the axis of rotation of the wheel in the manner described above facilitates formation of micro bevels, relocation of the axis of rotation of the wheel by greater amounts can enable honing of a wider range of bevel angles. Accordingly, a second way of achieving such additional versatility with expanded bevel angle range may be accomplished in the honing guide of this invention by providing structure that permits the location of the wheel support structure to be move relative to the blade securing or carrier structure. This can be achieved by making the blade carrier and the wheel frame separate parts may be secured together in more than one relationship. "Wedges" and "valleys" incorporated in the contacting surfaces of the blade carrier and wheel frame make it easy to repeatably join these two parts in multiple alternative relative positions and rigidly secure the components to each other in each of the alternative positions.

It is thus an object of this invention to provide improved honing guides. The improved honing guides of this invention can accommodate a wider range of chisel and plane blade sizes than prior guides, including skew chisels and blades.

It is another object of this invention to provide a honing guide that facilitates accurate production of micro-bevels.

It is another object of this invention to provide a guide that can be more easily and accurately positioned for use on a chisel or plane blade or other tool and is more securely attachable to a chisel or plane blade than prior guides.

It is a further object of this invention to provide a honing guide that positions a tool or blade for sharpening by reference to the tool or blade's longitudinal cutting arris-forming surface.

It is another object of this invention to provide a guide for holding a tool while grinding the tool on a motorized grinding wheel, belt or other abrasive by engaging the grinder's tool rest with guide structure.

It is an object of this invention to provide a tool or blade positioning jig for use with the guide that facilitates accurate positioning of the tool or blade in the guide to form a bevel at a desired angle and with minimal removal of blade material.

It is an object of this invention to provide a honing guide and tool or blade setting jig that facilitate accurate repositioning of the tool or blade in the guide in a desired bevel-forming position.

It is another object of this invention to provide a honing guide and bevel setting jig that can be economically manufactured utilizing components made from aluminum extrusions, zinc die-castings, or plastic.

It is a further object of this invention to provide a concave surface clamp bar that improves the blade-holding ability of the honing guide assembly.

It is a further object of this invention to provide a honing guide capable of honing a wide range of bevel angles, including such angles smaller than 20° and larger than 40°.

It is a further object of this invention to provide a honing guide capable of accommodating chisels or other blades that are very short.

These and other benefits of this invention may be understood by reference to the following drawings, the description set forth below, and the claims.

BRIEF DESCRIPTION OF THE DRAWINGS

FIG. 32 is a perspective view of a top and left side of a honing guide and jig, where the jig is adapted to remain attached to the honing guide during honing, and is hinged to pivot away from the abrasive surface of a sharpening stone, grinding wheel, or the like.

DETAILED DESCRIPTION OF THE DRAWINGS

Figure 1:
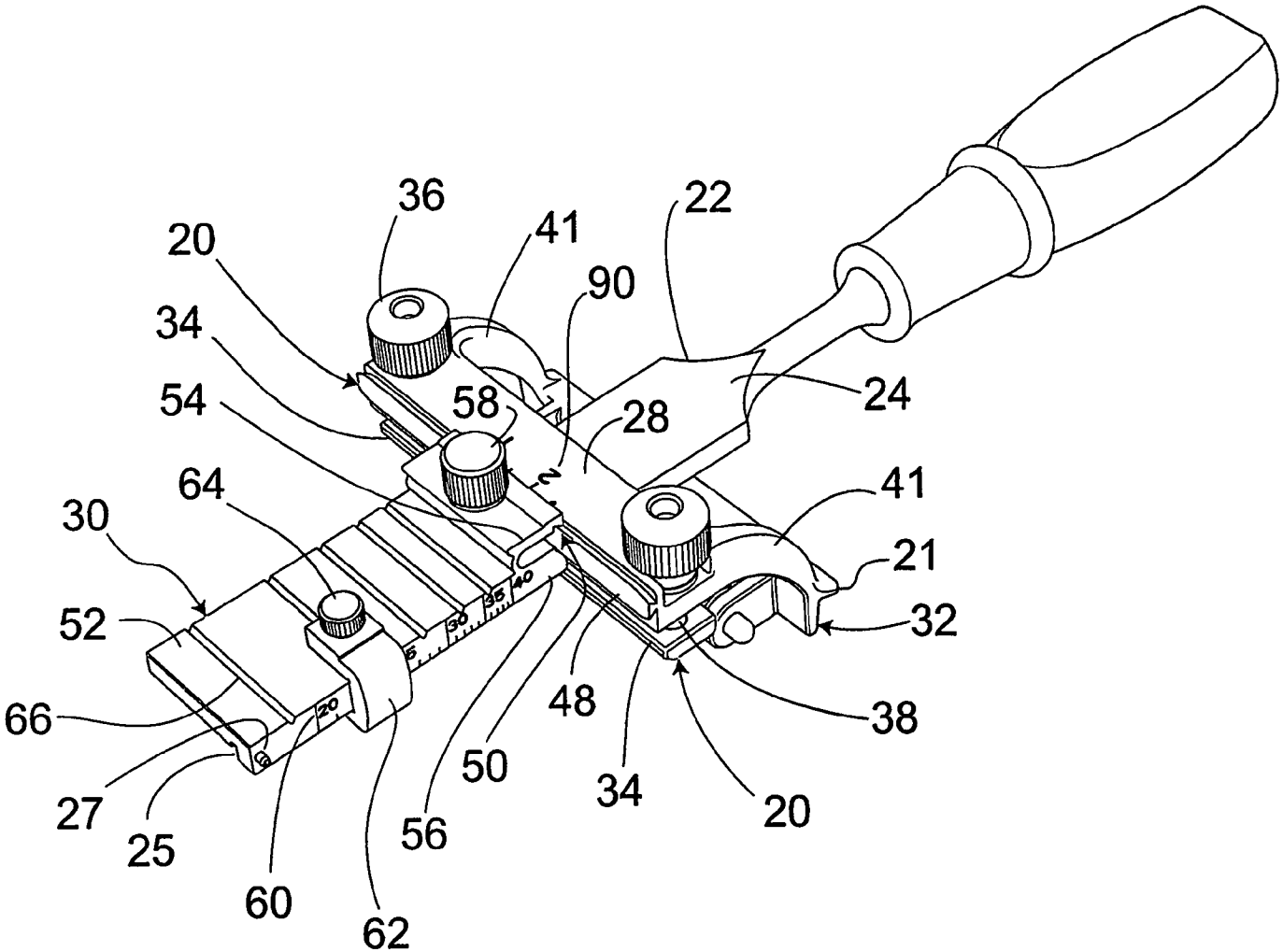
FIG. 1 is a perspective view showing an illustrative embodiment of the honing guide and associated bevel setting jig of this invention positioned on a bench chisel.

The chisel and plane blade honing apparatus of this invention illustrated in FIGS. 1-12 includes three principal components: a blade holding guide 20 and two bevel setting jigs: a square end chisel or blade bevel setting jig 30 and a skew chisel or blade setting jig 40. As may be understood by reference to FIGS. 1 and 2, a tool or blade such as a bench chisel 22 is secured in blade holding guide 20 with back or reference surface 24 of the chisel 22 forced against a guide reference surface, which is the underside 26 (see FIG. 7) of beam 28 of guide body 32. Bar 34 is drawn against chisel 22 by rotating thumb nuts 36 on threaded studs 38. Bar 34 is adjustable both laterally and longitudinally as may be well appreciated by reference to FIG. 2, arcuate, forward-reaching guide arms 41 connect beam 28 to roller 42 that contacts an abrasive surface 44 of, for instance, a sharpening stone 46 during use of the guide 20. These arcuate, forward-reaching arms 41 enable guide 20 to grasp chisel 22 or other tools relatively close to their ends.

Bar 34 is desirably relatively rigid so that it can be used with narrow, as well as wide, chisels 22 or other blades or tools without bending significantly. At the same time, positioning of bar 34 near the end of the chisel 22 requires that the forward-most portion of bar 34 be relatively thin so that it will not contact abrasive surface 44, as will be particularly well appreciated by reference to FIG. 2. Such desired rigidity with an abrasive contact-avoiding shape can be achieved by using a generally triangular cross sectional shape for bar 34, or a shape that is generally a constant thickness near the bar 34 ends and that swells to such a triangular cross-sectional shape in the middle, as is illustrated in the figures, particularly including FIGS. 2 and 7. In other words, there is a leading chamfer on the bar 34. Attachment of bar 34 with thumb nuts 36, which may be undercut, on studs 38 positions the nuts 36 on the top of the jig, where they are easily accessible and do not prevent the desirable geometry of the underside of guide 20.

Figure 2:
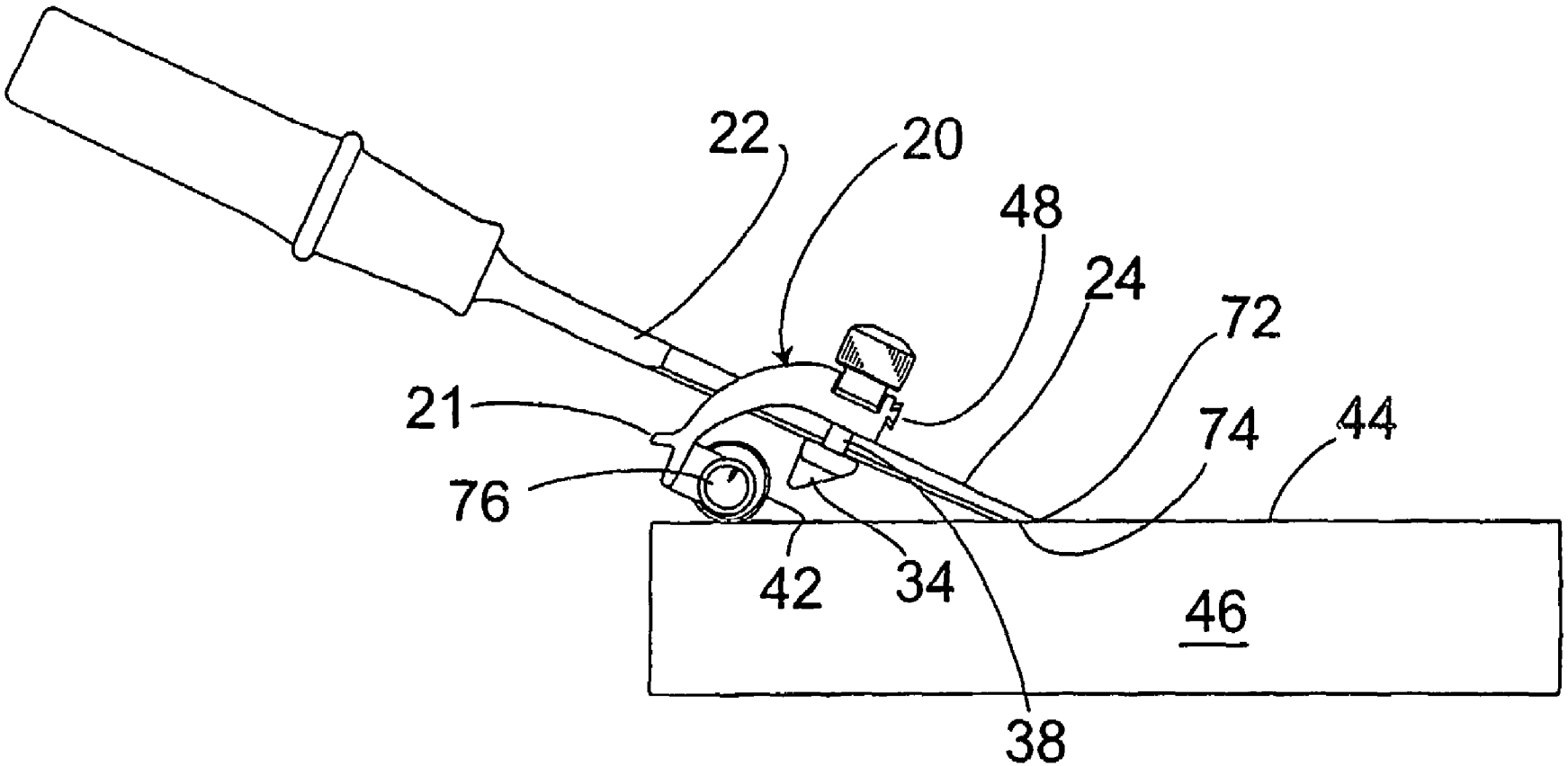
FIG. 2 is a left side view of the honing jig and bench chisel shown in FIG. 1 positioned on a sharpening stone.
Figure 3:
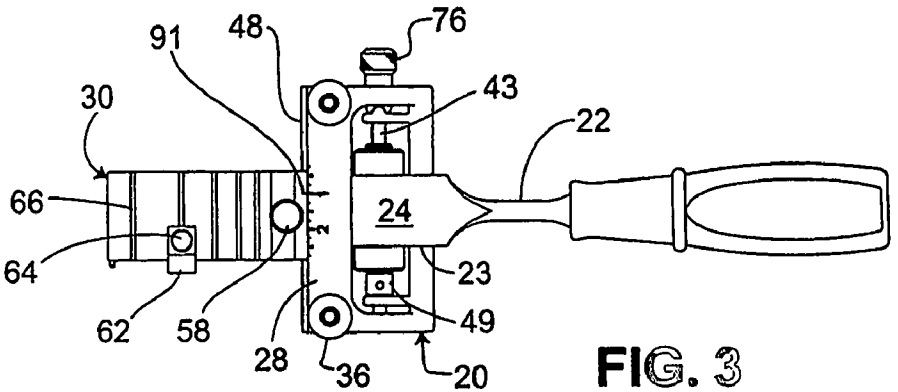
FIG. 3 is a top plan view of the honing guide, bevel setting jig and bench chisel shown in FIG. 1.
Figure 4:
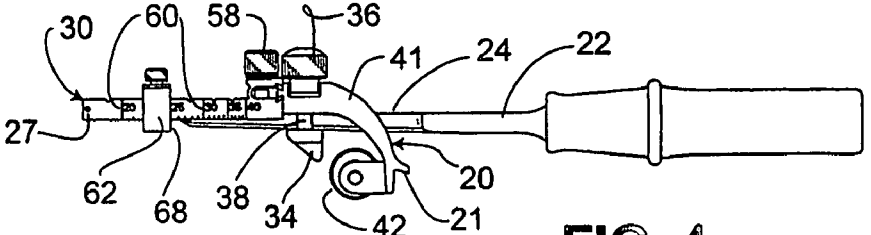
FIG. 4 is a right side view of the honing guide, bevel setting jig and bench chisel shown in FIG. 1.

As will also be appreciated by reference to FIG. 2, the bevel angle that will be formed on chisel 22 during use of the guide 20 is a function of the length of chisel or plane blade projecting beyond the guide 20. Longer projection forms a shallower bevel angle. Such blade projection and proper orientation may be set by use of the bevel setting jig 30 or skew bevel setting jig 40, each of which couples to the guide during use of the setting jig 30 or 40, but which is removed during honing using the guide 20 in the illustrated embodiments.

Figure 32:
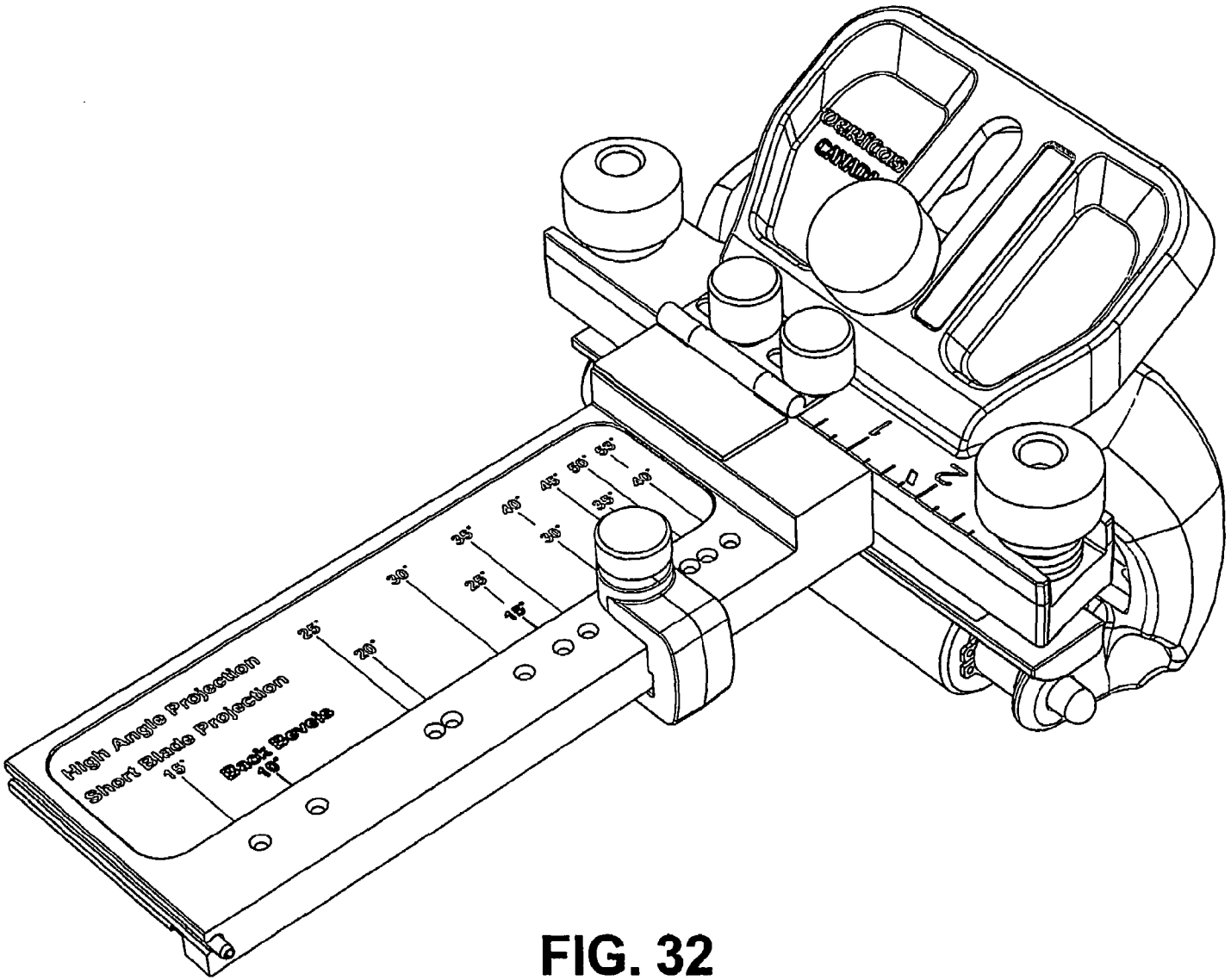

In the alternative, a jig 30 or 40 could be configured to remain attached to a guide during honing provided that it pivots out of the way or otherwise avoids preventing or unduly impairing honing functionality. One embodiment of this feature is illustrated in FIG. 32. Bevel setting jig 130 is removably attached to blade holding guide 120 by threaded posts or set screws 218 which secure hinge 220 to guide 120. In this embodiment, hinge 220 allows bevel setting jig 130 to pivot away from the abrasive surface of a sharpening stone, grinding wheel, or the like, but remain attached to guide 120, rendering the device more convenient to use. As illustrated, the lateral position of jig 130 relative to guide 120 can be varied by loosening posts 218, sliding hinge 220 along slots 222, and retightening posts 218 to secure jig 130 in its new position. Those of skill in the art will recognize that jig 130 is illustrated as rigidly attached to jig 130, and this can be obtained by welding or other appropriate method, and that equivalent functionality can be provided by locating posts 218 and slots 222 on the jig 130 instead of, or in addition to, on the guide 120. Alternatively, the hinge can be rigidly attached to both the jig 130 and the guide 120, if adjustability or removability are not desired, e.g., to reduce manufacturing or materials costs.

In the illustrated embodiment, the jig 30 attaches to a sliding dovetail 48 formed on the front guide beam 28 so that the jig 30 is generally co-planer with the honing guide 20. Dovetail 48 is received in a dovetail way 50 on jig body 52. Jig arms 54 and 56 may be tightened against dovetail 48 by rotating thumb screw 58 to draw the jig arms 54 and 56 toward each other. Although the dovetail 48 structure is well adapted for temporary connection of the jigs 30 and 40 to the guide 20, any other attachment structures that temporarily and properly position the jig being used with respect to the guide could be used instead. For instance, such attachment could be accomplished with one or more screws or bolts, pins in one of the guide 20 or jig 30 or 40 could be received in holes in the other of the guide or jigs, or a tongue on one of the guide or jigs could be received in a groove in the other of the jigs or guide.

A series of parallel indicia lines 60 on jig body 52 may be marked with various bevel angles, and a jig stop 62 may be positioned on jig body 52 in predetermined locations using a securing device 64. Securing device may be a knurled head thumb screw threaded into stop 62 or a spring loaded pin, either of which may be received in one of several pin grooves 66 in jig body 52. Other securing devices 64 could be used, such as cam-acting clamps or any other structure that repositionably secures stop 62 in a selected desired location. Pin grooves 66 are preferably located at intervals that will position stop 62 to in turn position a chisel or blade for forming bevels 74 that form, with the reference surface 24 of the tool, angles between 20° and 40° in five degree intervals. A spring loaded ball or pin received in grooves 66 may also be used, as may a variety of other structures for securing stop 62 at any predetermined or other desired location on jig body 52. For instance, predetermined positioning of stop 62 could be achieved by penetrating jig body 52 with holes into which an end of securing device 64 is inserted to position stop 62 at the positions determined by hole locations. The location of stop 62 may be read by reference to the stop's location along the scale formed by indicia 60. While indicia 60 are illustrated on the side of jig 30, they could also be located on the top or bottom of jig 30.

Figure 5:
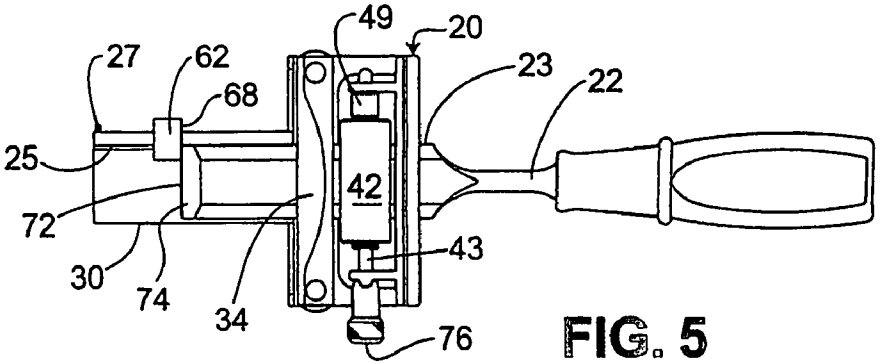
FIG. 5 is a bottom plan view of the honing guide, bevel setting jig and bench chisel shown in FIG. 1.
Figure 6:
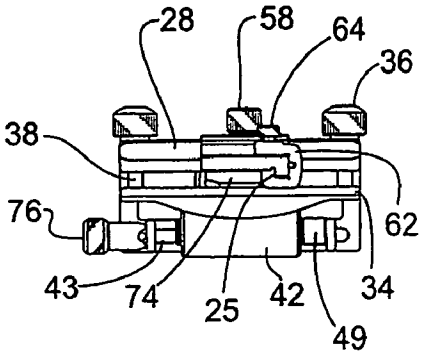
FIG. 6 is a front or end-view, looking toward the sharp end of the chisel, of the honing guide, bevel setting jig and bench chisel shown in FIG. 1.
Figure 7:
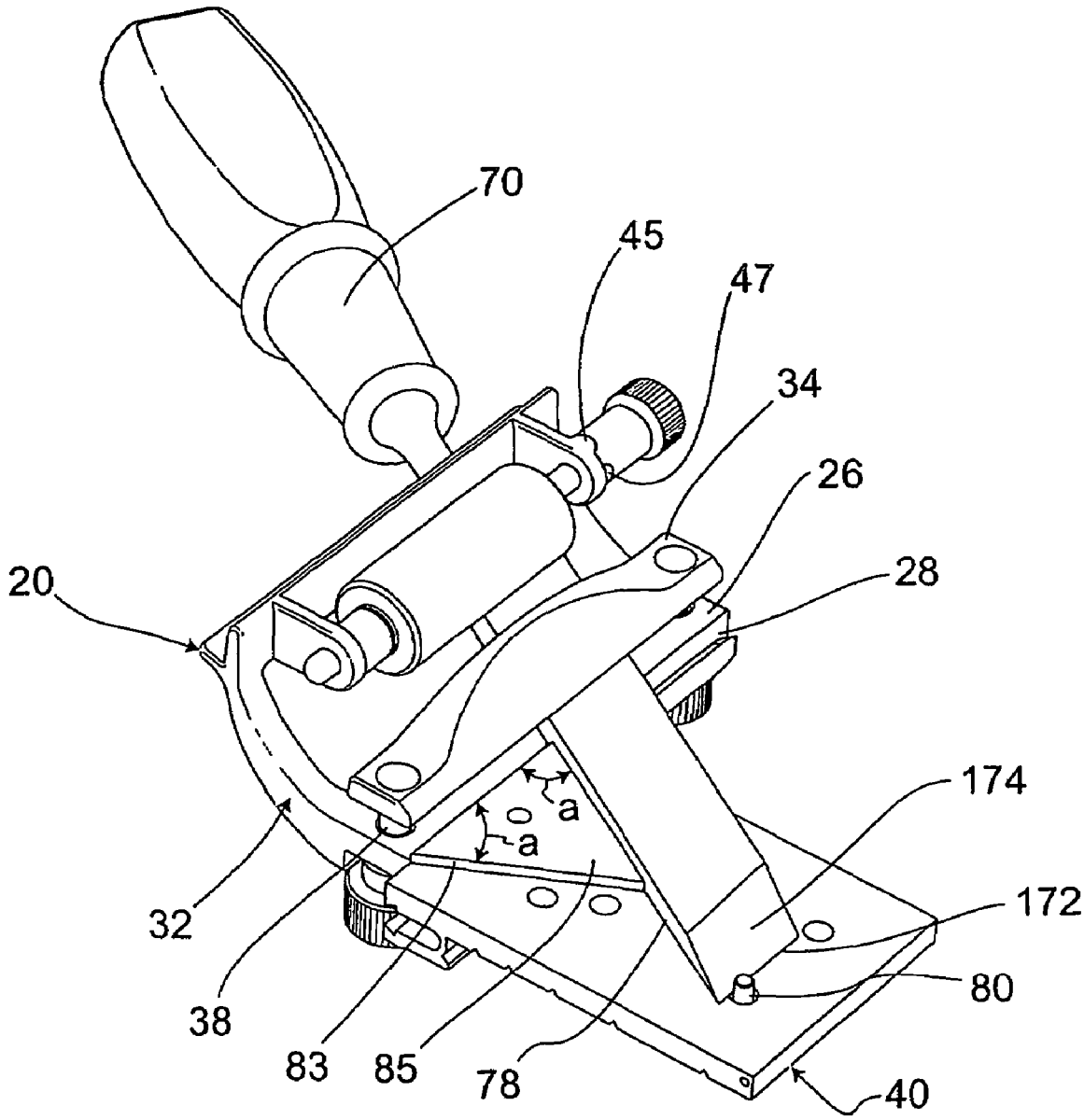
FIG. 7 is a bottom perspective view showing the bottom and right side of the honing guide and with a skew chisel and a bevel setting jig designed for use with a skew chisel secured in the guide.
Figure 8:
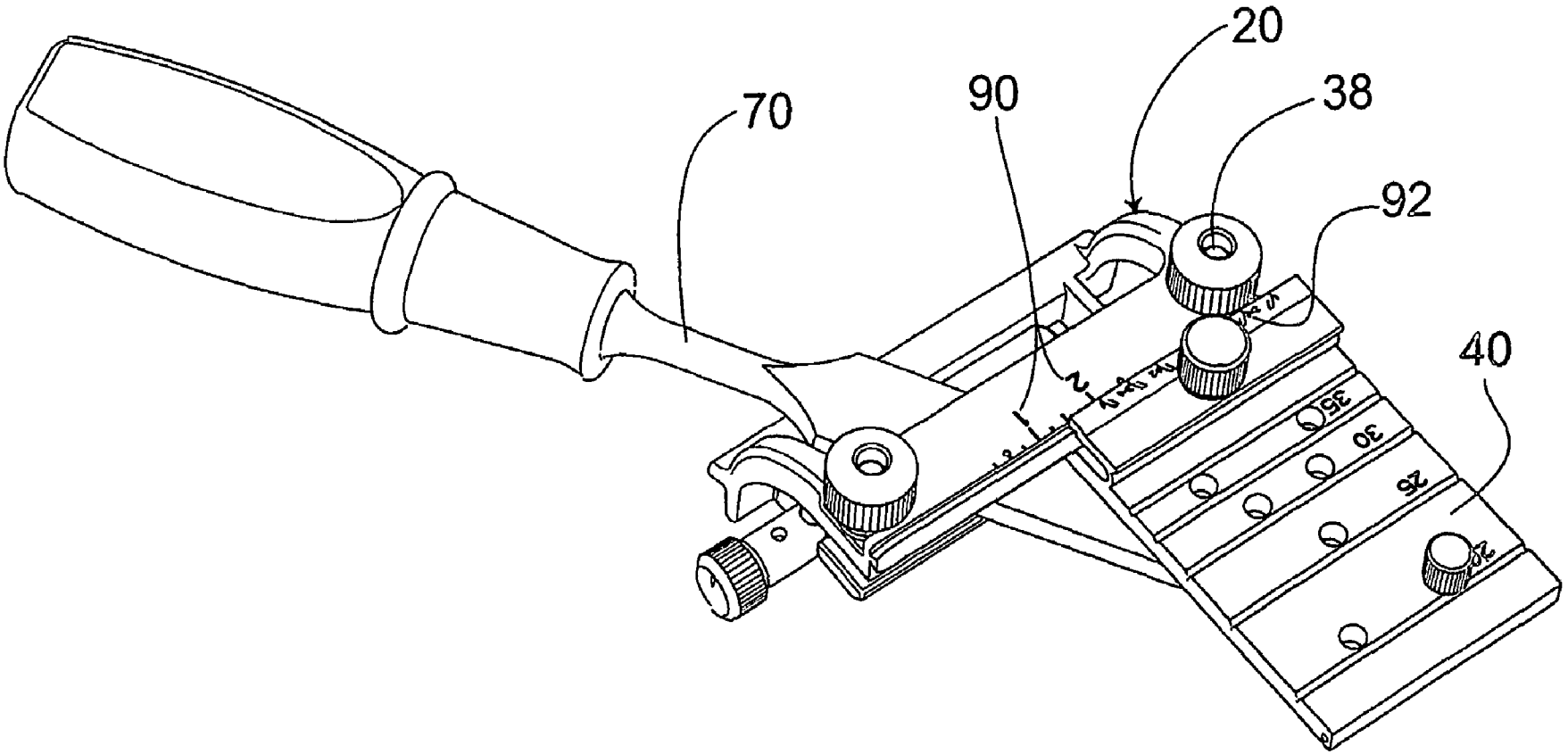
FIG. 8 is a perspective view showing the top and left side of the guide, jig, and skew chisel shown in FIG. 7.
Figure 9:
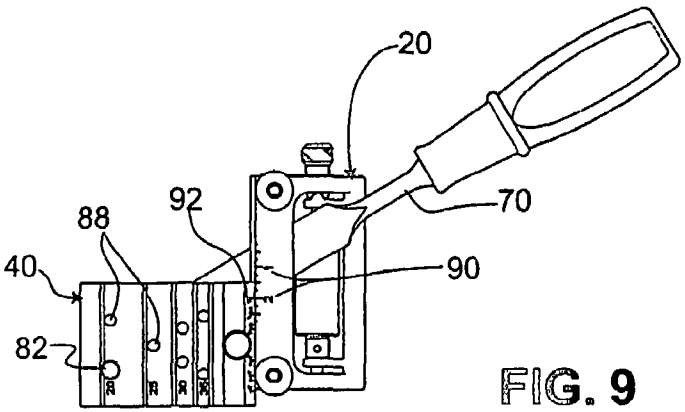
FIG. 9 is a top plan view of the guide, jig, and skew chisel shown in FIG. 7.
Figure 10:
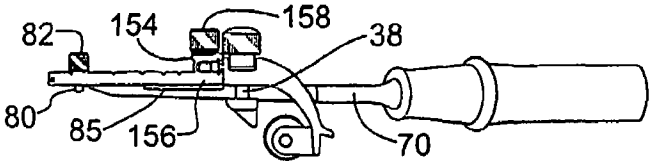
FIG. 10 is a right end view, looking toward the sharp end of the skew chisel, of the guide, jig, and skew chisel shown in FIG. 7.
Figure 11:
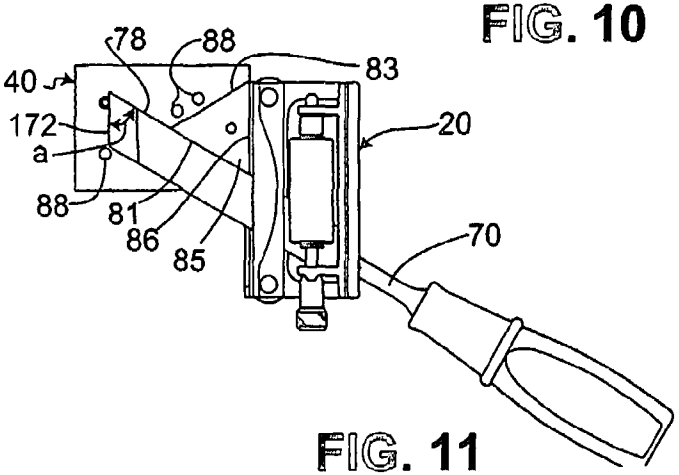
FIG. 11 is a bottom plan view of the honing guide and bevel setting jig of this invention and the skew chisel shown in FIG. 7.
Figure 12:
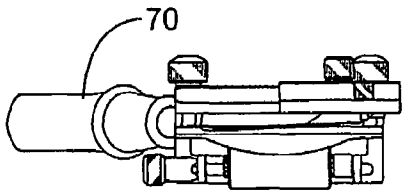
FIG. 12 is a front or end view looking toward the sharp end of the skew chisel and of the guide and jig shown in FIG. 7.

As may be best appreciated by reference to FIGS. 5 and 6, chisel 22 is positioned "square" in jig 20 (with the longitudinal axis of the tool 22 at right angles relative to the axis of roller 42) by positioning the edge 23 of chisel 22 against jig reference fence 25 which is "square" to the roller 42. This automatically positions the chisel or blade 22 to form an arris 72 square to the tool. Stop 62 wraps around fence 25, preventing removal of stop 62 by lateral movement, and a pin 27 prevents stop 62 from sliding off the end of jig 30 by moving stop along fence 25. While fence 25 is shown along one edge of jig body 52, such a fence 25 could be located on the opposite edge of jig body 52 or at any intermediate position between those edges. The function of reference fence 25 could also be served by other structures such as, for instance, an aligned row of pins in jig body 52 so that a side of the chisel or blade can lie against two or more of such pins. Moreover, stop 62 could be omitted entirely in favor of positioning of a chisel 22 or blade in guide 20 by visual reference between the position of the arris 72 and a scale or other indicia on jig body 52.

Adjacent to, and substantially parallel to, fence 25 is groove 25A, which is adapted to receive a pin (not shown) projecting from stop 62. This pin slidably engages groove 25A and provides a contact surface for the edge of the blade being sharpened. This prevents the blade from wedging itself between the underside of jig 30 and the opposing surface of stop 62.

After a principal bevel has been formed by abrading the bevel surface 74 against an abrasive surface such as stone 46 surface 44, the axis of rotation of roller 42 may be positioned further from back surface 24 of the chisel, thereby slightly lifting the tool or blade 22 and slightly increasing the angle of the tool or blade 22 by reference to the abrasive surface 44. This facilitates the easy formation of a micro bevel on the tool 22. Such axis of rotation movement may be accomplished, for instance, by rotating knob 76 that is part of an eccentric mechanism described in U.S. Pat. No. 4,733,501, the entirety of which patent is incorporated herein by reference.

For instance, in the embodiment of the invention shown in the figures, the roller 42 may be moved between the two positions by moving the position of the axle 49 on which the roller 42 rotates. The axle 49 may be eccentrically positioned on a shaft 43 that is spring loaded to hold a knob 76 on the end of the shaft 43 against a protrusion 45 (see FIG. 7) on the guide body 32 in one of at least two detents 47 in knob 76. The knob 76 is pulled axially to overcome the spring (not shown but positioned around the exposed portion of shaft 43 between roller 42 and protrusion 45) and disengage the detent 47 from protrusion 45 and rotated to engage another detent 47.

Honing guide 20 may also be used as a grinding jig. Structure behind the roller 42, such as a protruding ledge 21 easily seen in FIGS. 1 and 2, enables the guide 20 to rest on a tool rest on a typical motorized bench grinder, belt grinder or other motorized abrasive device. This will allow the user to position a tool such as chisel 22 to be sharpened once in the guide for both rough grinding and fine honing.

FIGS. 7-12 illustrate use of guide 20 with a skew chisel 70. Positioning of a skew chisel 70 in the honing guide 20 can be facilitated by contact between a chisel side 78 and a reference face 81 of a reference block 85 positioned on skew setting jig 40 and with the skew chisel cutting arris 172 contacting a reference pin 80 on the end of a knurled head thumbscrew 82.

The reference faces 81 and 83 of reference block 85 form the same angle "a" with base side 86 of block 85 as longer side 78 of skew chisel 70 forms with arris 172. A "right hand" skew is positioned on one side of the block 85 and a "left hand" skew is positioned for sharpening on the other side of block 85. For skew chisels having an arris at a different angle, a different block 85 with different angles "a" will be needed. Block 85 can be removably attached using appropriate fasteners such as screws (not shown), permitting use of interchangeable blocks for skews with different angles. Preferably, however, block 85 will be formed as a part of skew-setting jig 40, which is feasible because most skew chisels have the same angle (60°). As in setting jig 30 described above, arms 154 and 156 of jig 40 tighten against opposite sides of dovetail 48 in order temporarily to position jig 40 on guide 20 during positioning of skew chisel 70 in guide 20, but, as described above, any suitable alternative method of attachment could instead be used.

As may be understood by reference to FIGS. 7-12, skew jig 40 is penetrated by holes 88 within which reference screw 82 may be alternatively positioned in order to position pin 80 at predetermined locations that will result (when used together with block 85) in positioning skew chisel 70 to form a bevel 174 at a desired predetermined angle. Such a positioning pin 80 and holes 88 are a well-functioning stop structure for the skew jig 40 because the optimal stop positions do not lie along an edge of the jig 40, as may be done in the square-tool jig 40. Similar to the observation above about jig 30, other stop structures would also be used, however, in jig 40, and the stops could be entirely omitted in favor of visual reference between a skew chisel 70 and angle indicia on the jig 40.

Indicia 90 (see FIGS. 1, 3 and 9) on the body 32 of jig 20 are used by reference to a small mark 91 on jig 30. When using the guide 20 and jig 30, it will be necessary to secure the jig 30 in an appropriate position before the chisel 22 or other tool to be honed is clamped in place. Since it is desirable for the chisel 22 or other tool to be honed to be clamped so it is centered between arms 41 of the guide 20, it is necessary to know in advance where the jig 30 should be fixed on sliding dovetail 48 such that the resultant tool position is centered. The reference mark is to be aligned with the scale increment 90 to correspond to the width (in inches, for instance) of the chisel 22 or other tool, to be honed. Indicia 92 (see FIGS. 8 and 9) on jig 30 are used by reference to either one of two specially shaped reference marks within the scale 90 on guide 20 depending on whether the skew chisel to be sharpened is "left hand" or "right hand" and depending on the width of the skew, which will typically be one of three common widths, ½", ¾" or 1". This will ensure that the skew 70 is optimally positioned to achieve the best possible relative orientation between roller 42 and cutting arris 172. Indicia 92 may be laser etched or formed in some other appropriate manner making the indicia clearly visible to the user during set up.

As will be appreciated by those familiar with tool manufacture, the guide body 32 and bar 34 can be made by die casting. Components so formed can then be anodized to form an attractive and wear-resistant surface. Components of this invention can also be manufactured of other materials and utilizing other manufacturing techniques. For instance, components could be machined from steel, brass (particularly in the case of the screws), or aluminum bar stock or could be molded of suitable plastic or plastic composite materials or produced by zinc die-casting.

As will be appreciated by those skilled in the art, this invention can be practiced in numerous alternative embodiments in addition to those shown in the drawings and described above without departing from the spirit of this invention or the scope of the following claims.

For instance, one or more wheels could be used rather than the illustrated roller, and other structures could be used for shifting the axis of rotation of the roller in order to form micro bevels, or such structure could be omitted entirely if its micro bevel forming function were not desired. A jig in accordance with this invention could also be structured for contact between the roller 42 and reference structure other than the abrasive surface 44. For instance, roller 42 could be arranged to contact bench-top or other planar surface on which the abrasive 46 rests, as is done in some prior art honing guides.

Figure 14:
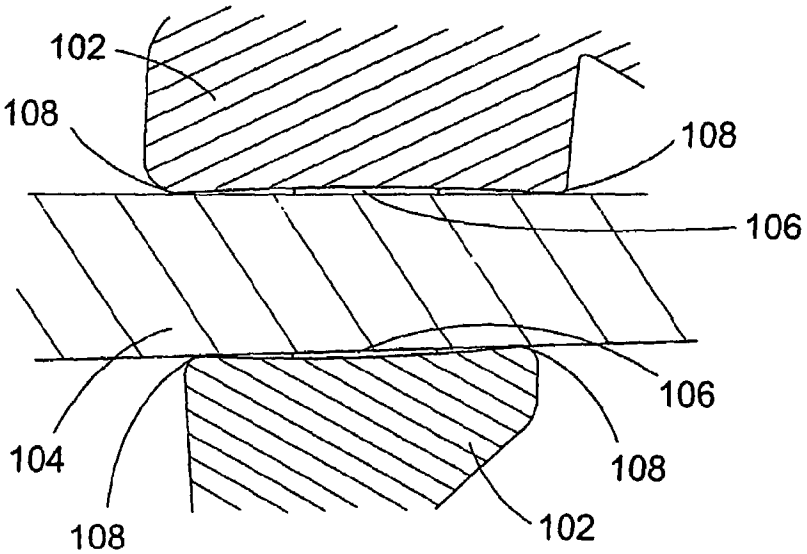
FIG. 14 is an enlarged view of the clamping surfaces of FIG. 14.
Figure 13:
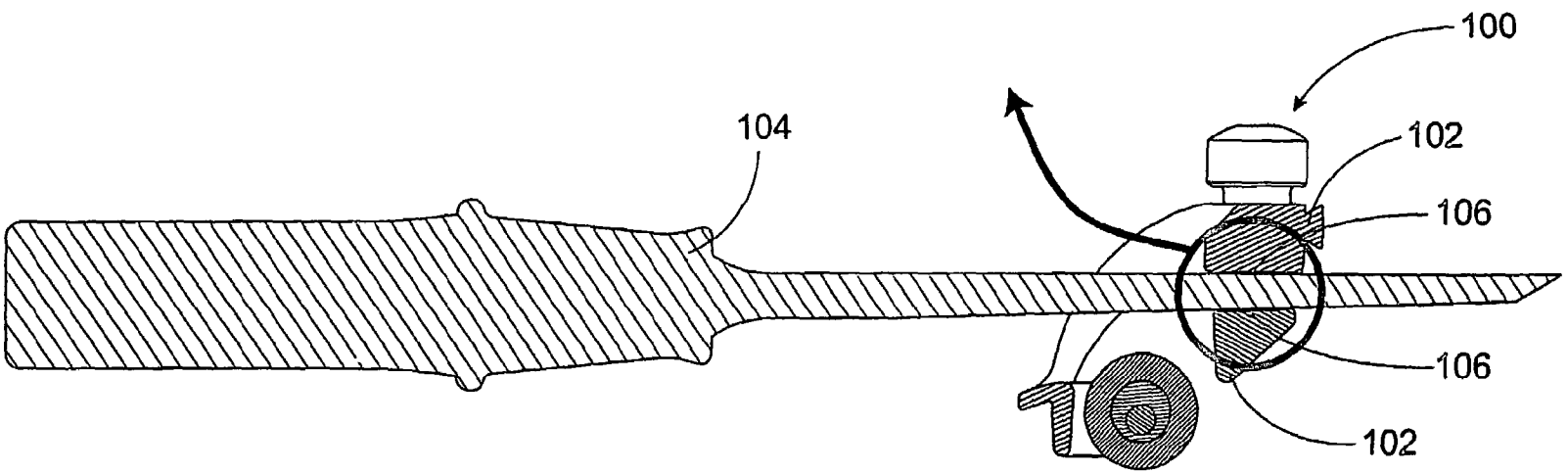
FIG. 13 is a side view in cross-section of the hollow blade clamp bar honing guide of this invention.

FIGS. 13 and 14 illustrate a honing guide 100 having clamp bars 102 between which a tool 104 is clamped in place for honing or sharpening. The concave clamping surface 106 of the bars 102 force regions of contact 108 between the tool 104 and the surface 106 as far apart as possible, so that the clamping force is concentrated along parallel lines at the edges of the bars 102.

Another possible variation of the blade honing guide of this invention involves utilization of structures that change the range of bevel angles possible. This can be accomplished by changing the positions of the wheel axis of rotation relative to the blade securing structure (as is done in the micro-bevel structure described and incorporated by reference above, but by greater amounts). This can also be done by changing the angular position of the blade being held by the guide, as for instance changing the planes of the surfaces that clamp the blade.

An alternative embodiment of this invention having provision for an increased range of bevel angles by making the blade carrier and wheel frame separate components is illustrated in FIGS. 16-19.

Figure 15:
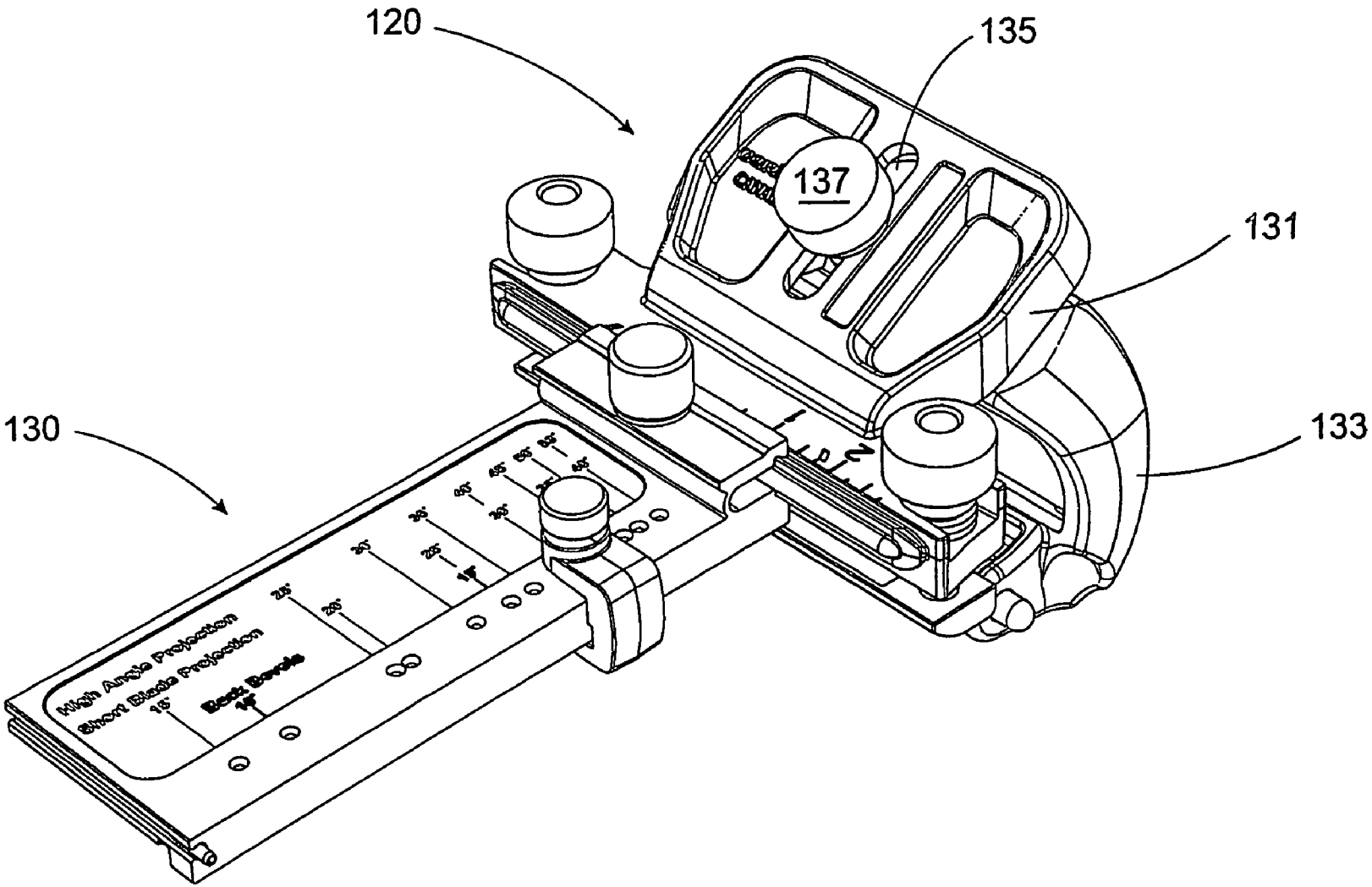
FIG. 15 is a perspective view of an alternative embodiment of the honing guide of this invention having separate blade carrier and wheel frame components that can be repositioned to accommodate a wide range of bevel angles.
Figure 16:
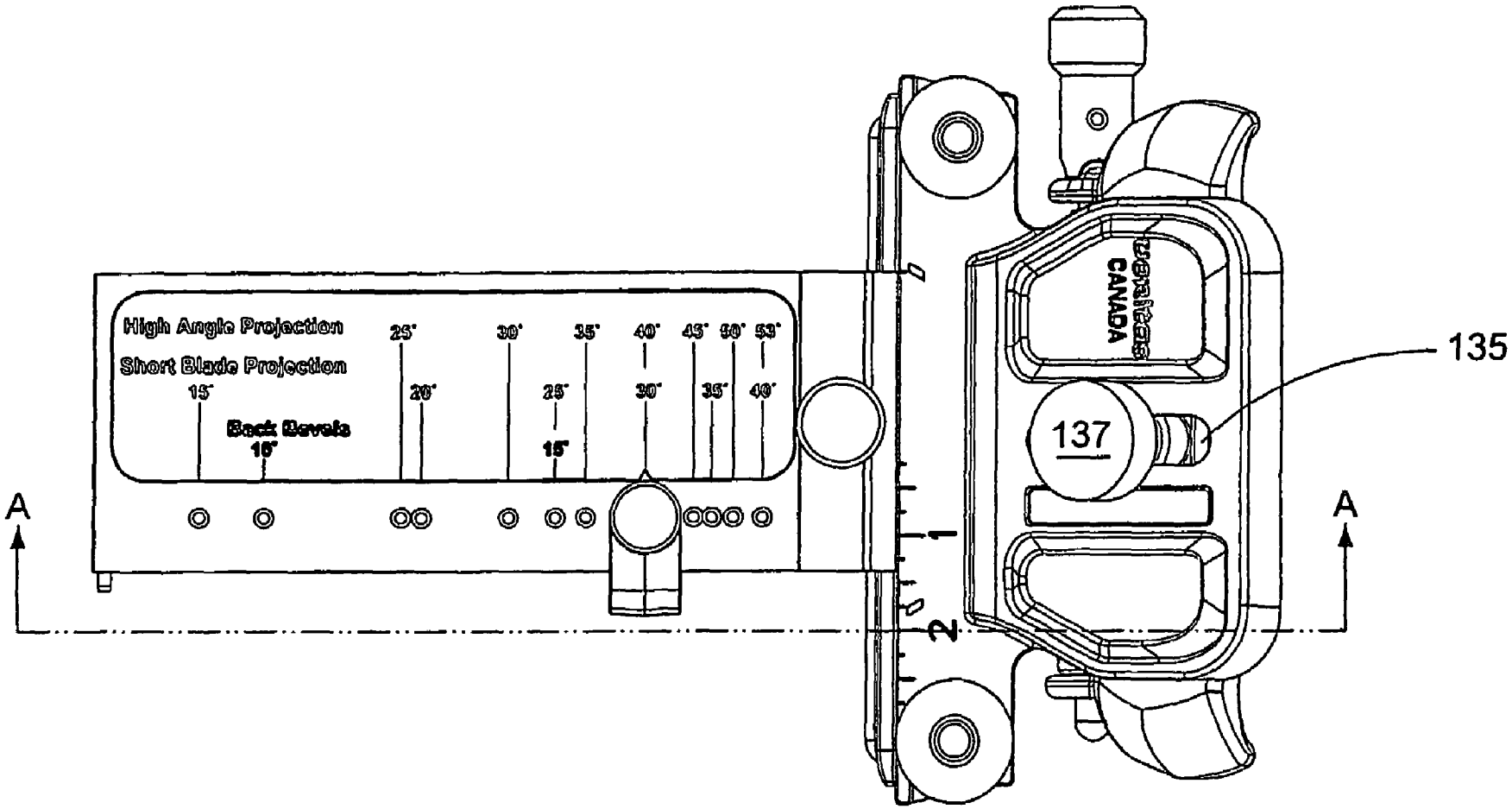
FIG. 16 is a top view of the alternative embodiment of the honing guide of this invention shown in FIG. 15.
Figure 17:
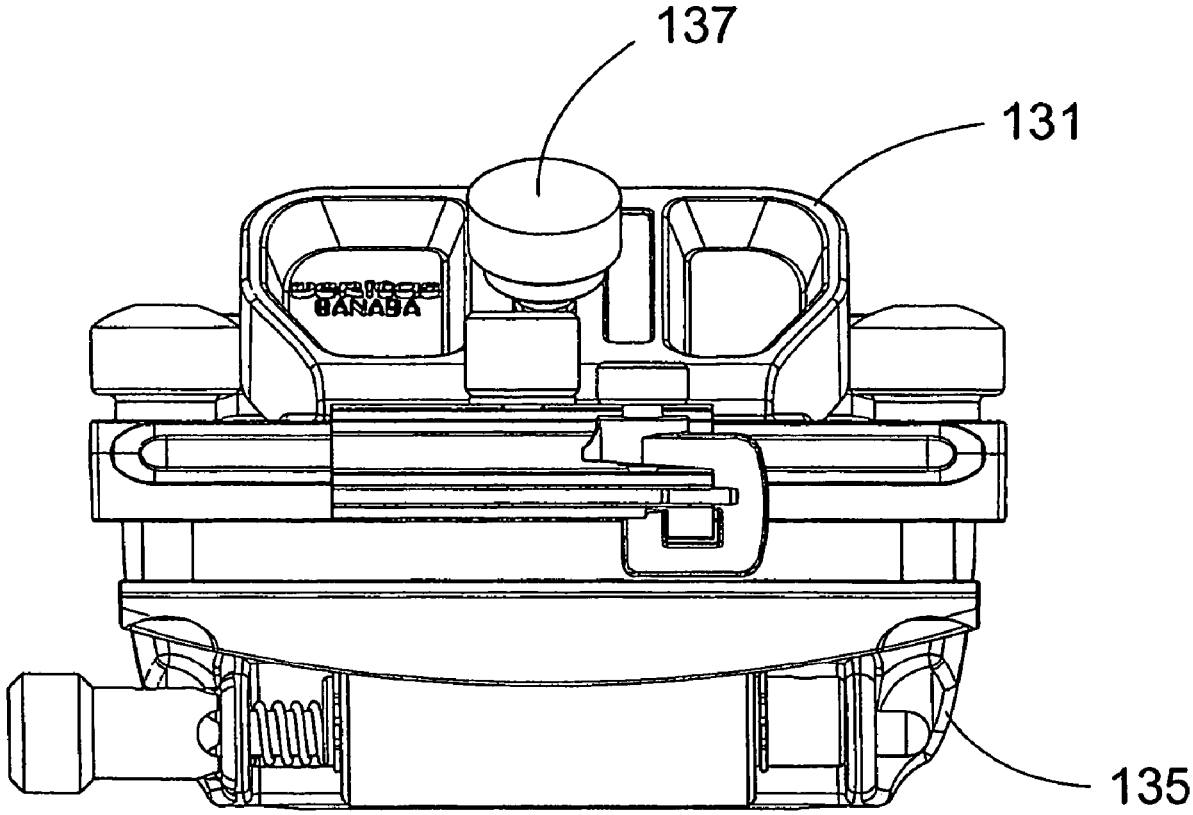
FIG. 17 is a front view of the alternative embodiment of the honing guide of this invention shown in FIG. 15.
Figure 18:
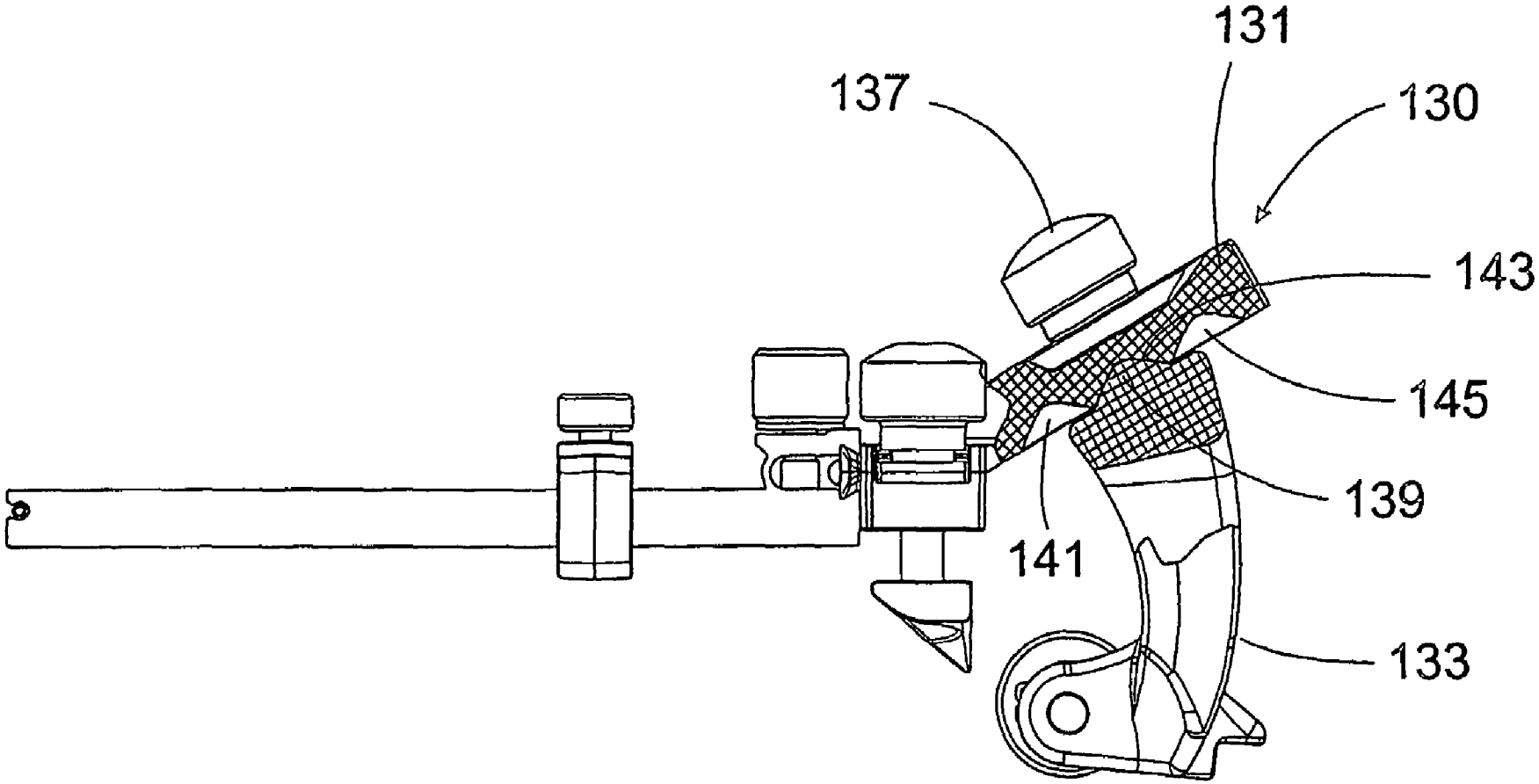
FIG. 18 is a view of right side the alternative embodiment of the honing guide of this invention shown in FIG. 15 with portions of the blade carrier and wheel frame broken away to illustrate how they inter-fit.
Figure 19:
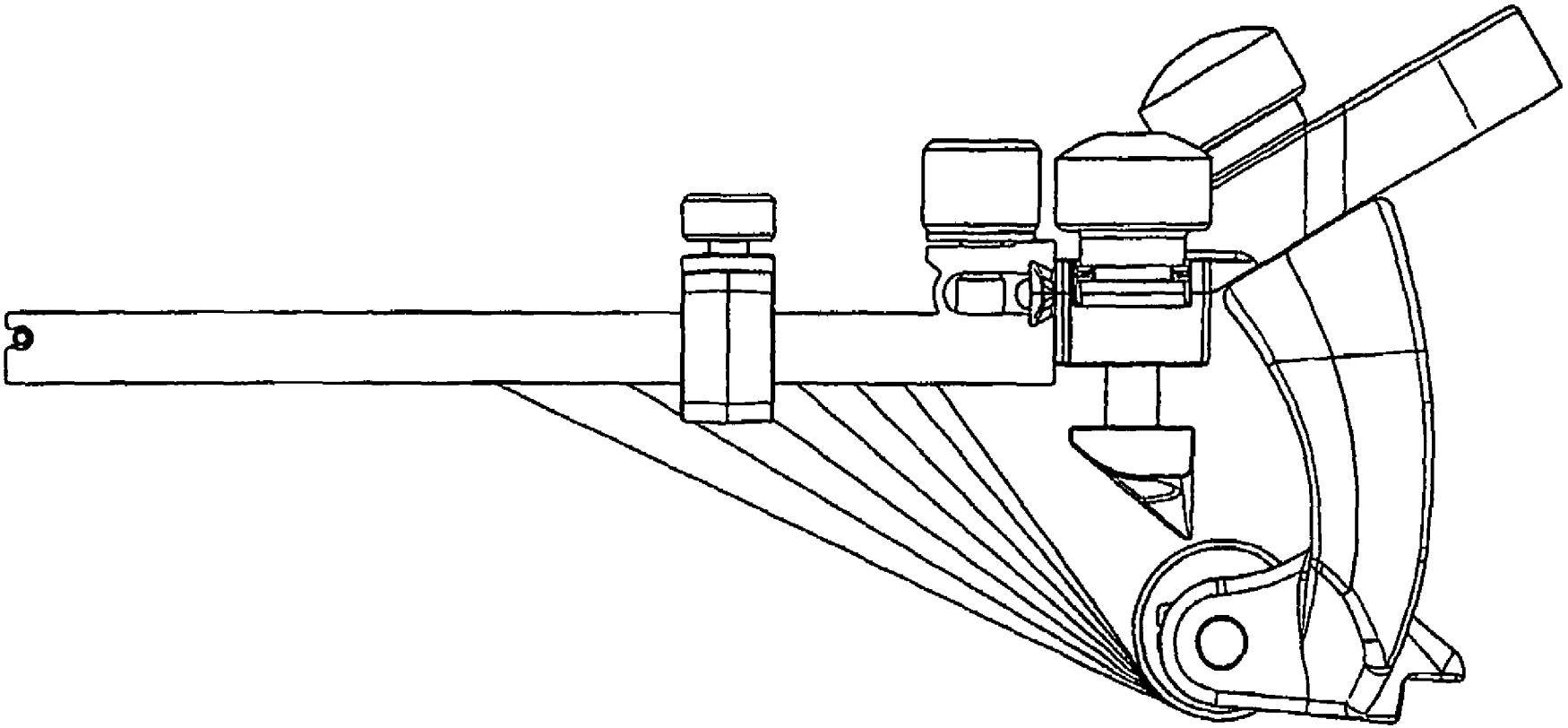
FIG. 19 is a view of the right side of the alternative embodiment of the honing guide of this invention shown in FIG. 15 with the blade carrier and wheel frame secured in a first position.
Figure 20:
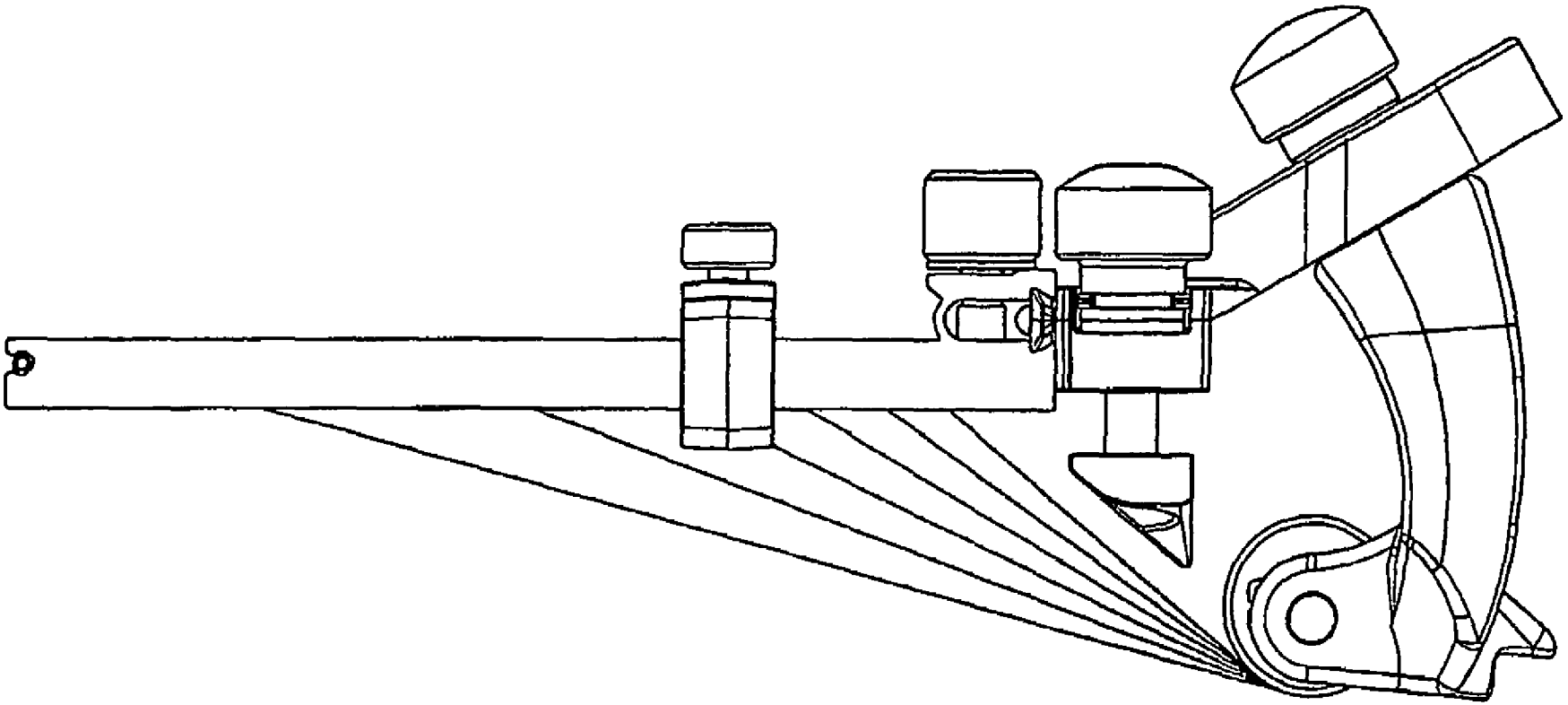
FIG. 20 is a second view like FIG. 19 with the blade carrier and wheel frame secured in a second position.
Figure 21:
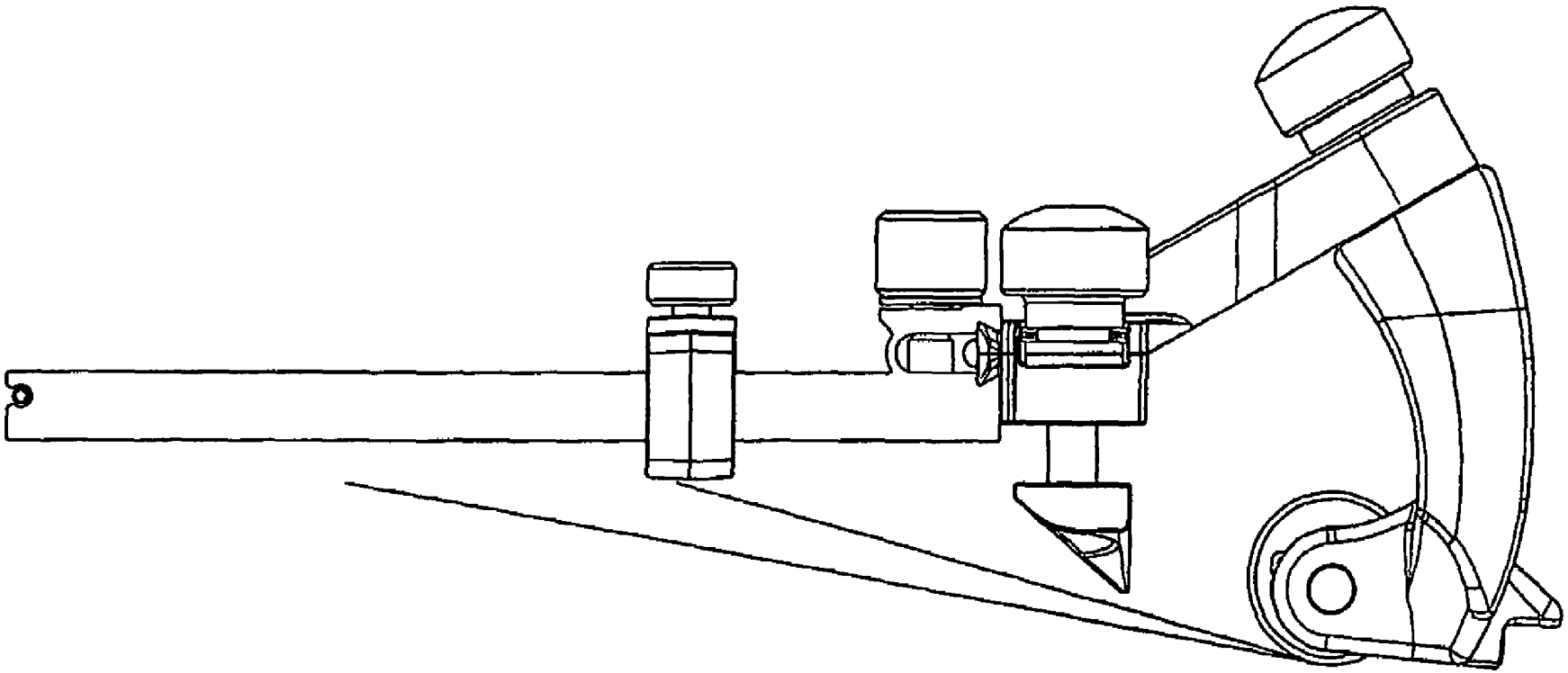
FIG. 21 is a third view like FIG. 19 with the blade carrier and wheel frame secured in a third position.
Figure 22:
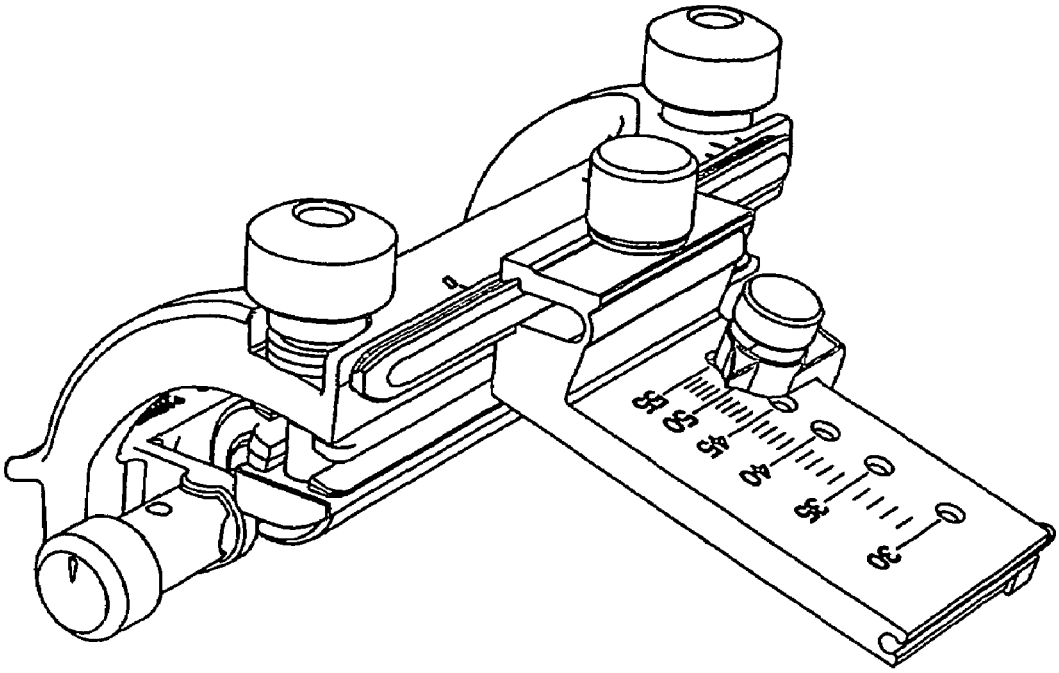
FIG. 22 is a perspective view of the top and left side of a honing guide and blade setting guide of this invention together with a pair of angle modifying wedges.
Figure 23:
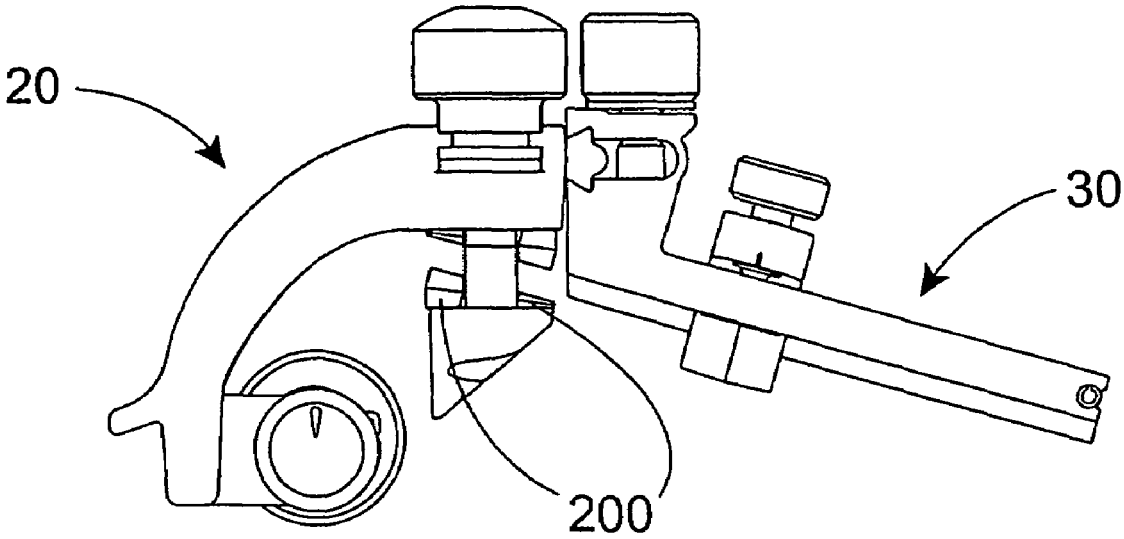
FIG. 23 is a left side view of the honing guide and bevel setting jig and wedges shown in FIG. 22.
Figure 24:
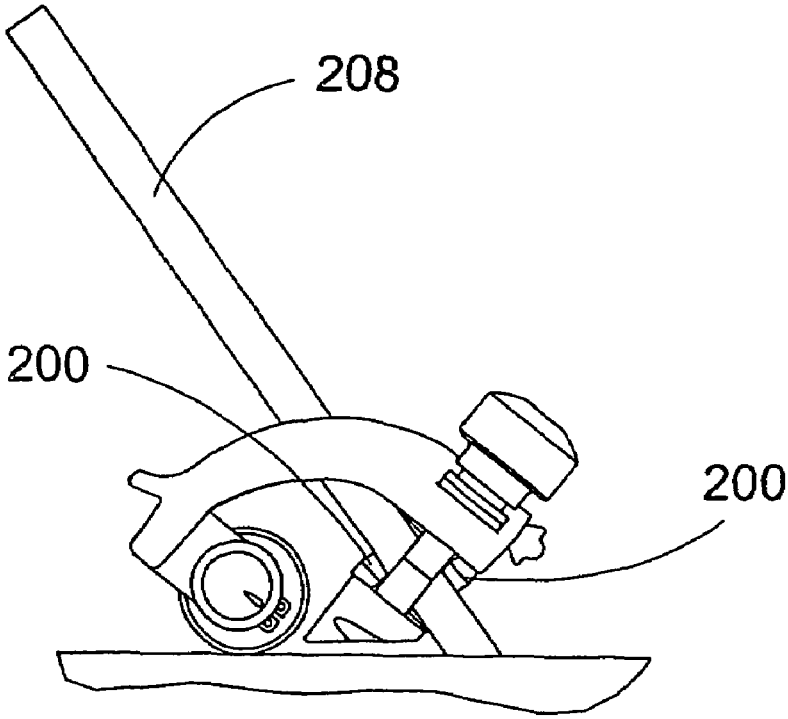
FIG. 24 is a left side view of the honing guide and wedges shown in FIG. 22 shown with a blade having a large bevel angle.
Figure 25:
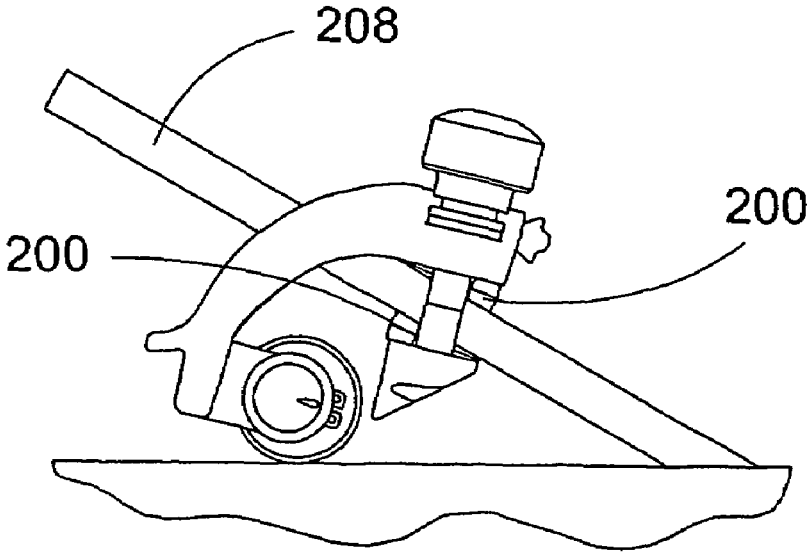
FIG. 25 is a left side view of the honing guide and wedges shown in FIG. 22 shown with a blade having a smaller bevel angle.
Figure 26:
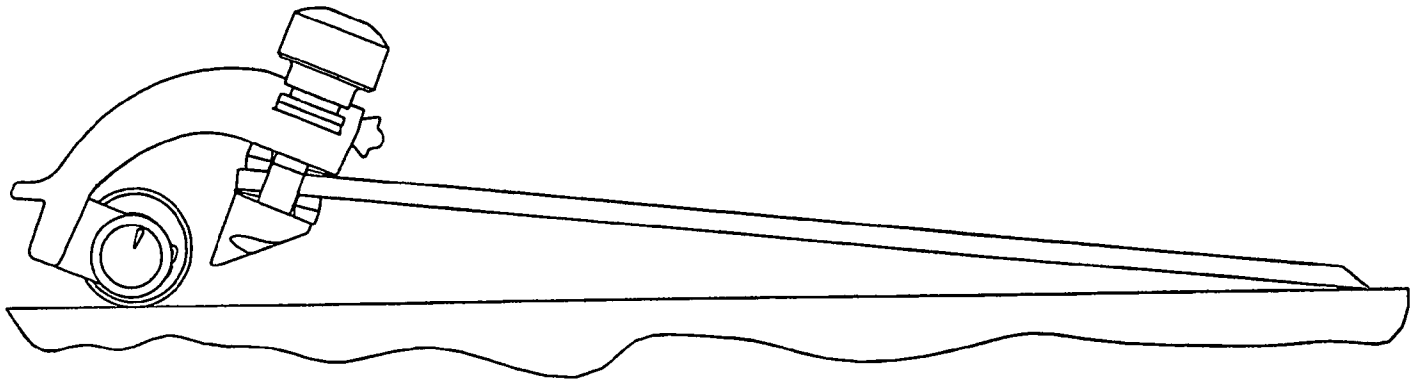
FIG. 26 is a left side view of the honing guide shown in FIG. 22, with the wedges reversed and a blade shown position to hone a very small bevel angle.
Figure 27:
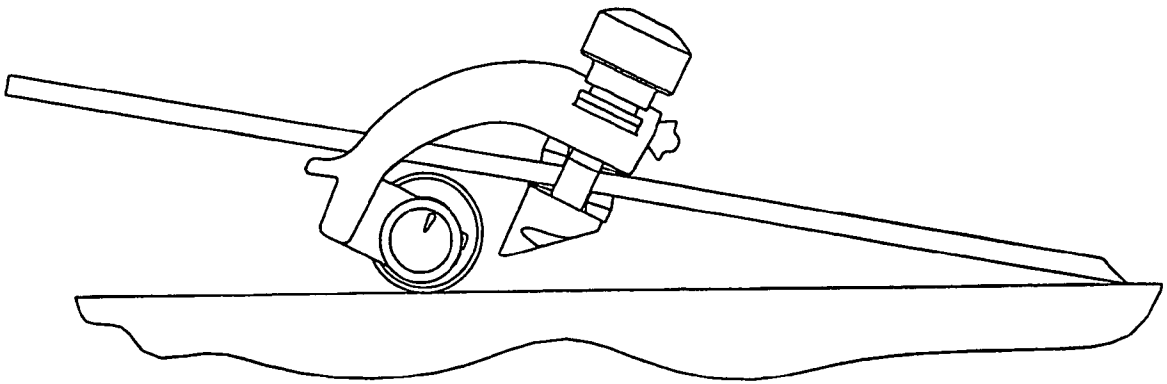
FIG. 27 is a left side view of the honing guide, wedges and blade shown in FIG. 26 with the blade positioned to bevel a somewhat larger bevel angle.
Figure 28:
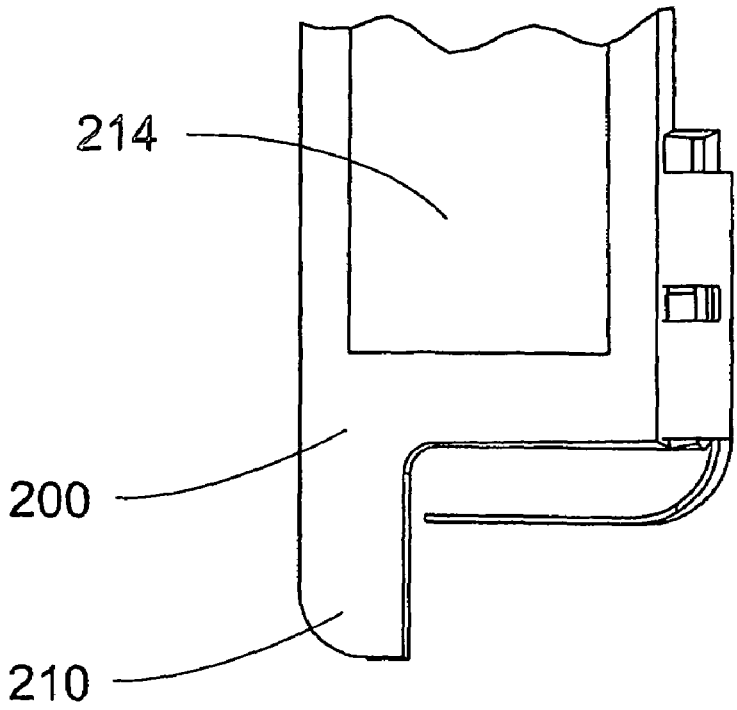
FIG. 28 is a fragmentary view of a wedge of the present invention like those shown in FIGS. 22-27 showing the leaf spring in its relaxed position.
Figure 29:
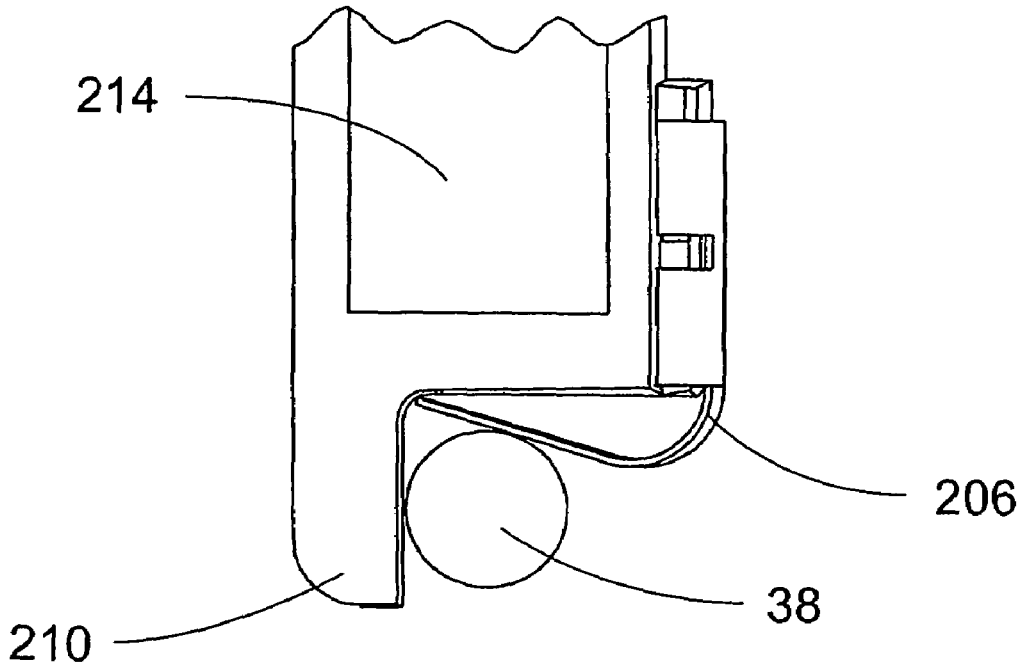
FIG. 29 is of the wedge of the present invention like those shown in FIG. 28 with the spring depressed by the blade securing screw or post.
Figure 30:
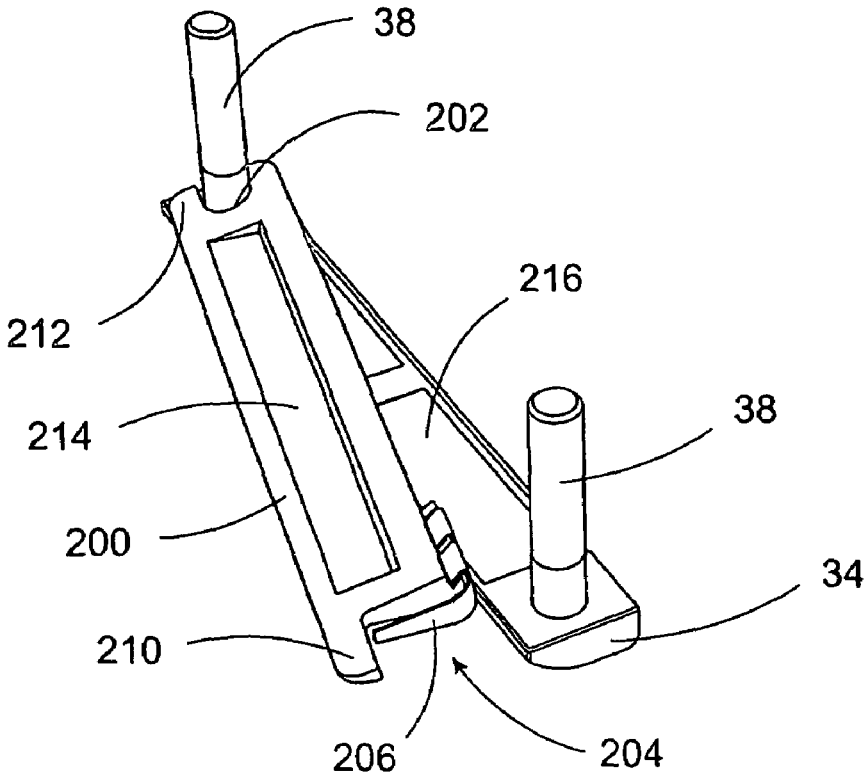
FIGS. 30 and 31 illustrate installation on the blade bar of a wedge of the type illustrated in FIGS. 22-29.
Figure 31:
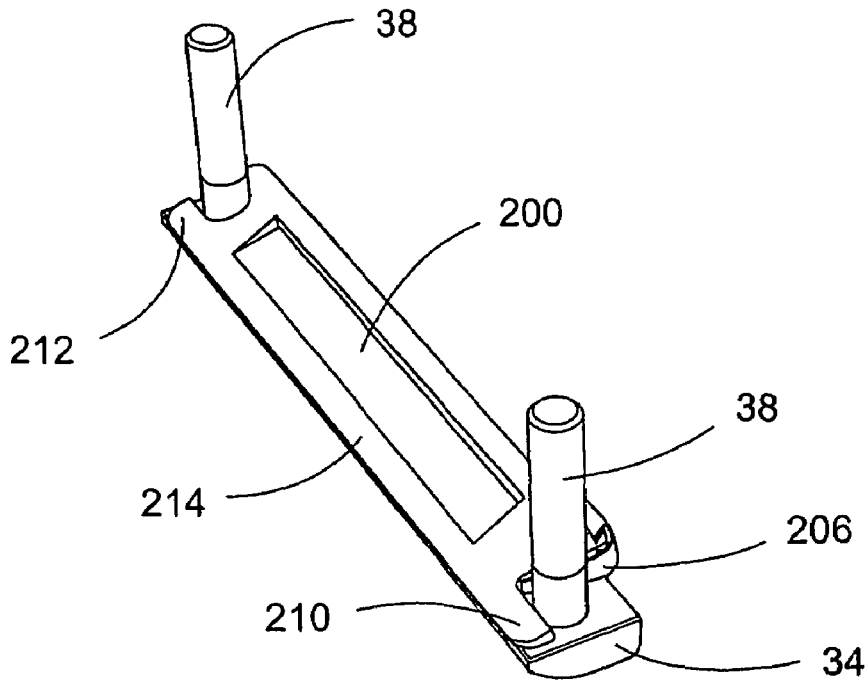

As is shown in FIG. 15, a guide 120 may be attached to a bevel setting jig 130, and these components function generally as described above by reference to the guide 20 and bevel setting jib 30. As is well illustrated by FIG. 18, the guide 20 has a guide body 132 provided by a blade carrier 131 and a wheel frame 133. Carrier 131 is secured to wheel frame 133 with a screw or stud (not shown) that passes through a slot 135 in carrier 131 and into wheel frame 133 and is tightened by rotating head or cap 137. Carrier 131 and frame 133 may be moved relative to each other and secured to each other in multiple positions. Such positioning could be in any relative location within a range of motion possible; however, it is preferable that an arrangement of detents, stops or other structure be provided so that relative positioning can be in repeatable locations. Such structure is provided in the guide 120 shown in the figures by the provision of a protruding ridge 139 on frame 133 that is alternatively received in one of three troughs 141, 143 or 145 on carrier 131. Configuration of the guide 120 with the protruding ridge 139 positioned alternative in each of troughs 145, 143 and 141, respectively, is shown in FIGS. 19, 20 and 21. As will be readily appreciated by reference to the Figures, particularly including FIGS. 19, 20 and 21, the different relative configurations of carrier 131 and frame 133 permit a wide range of bevel angles to be honed on blades and chisels secured in the guide 120. The joint between carrier 131 and frame 133 can be configured in three positions to allow three angel ranges, low angles (10° to 15°), mid range angles (15° to 40°) and high angels (25° to 65°).

Other structures than those illustrated in the Figures and described above can be used to join carrier 131 and frame 133. The mating surfaces of these components can have matching protrusions and recesses having many different structures or can utilize entirely different structures such as a sliding dovetail or other adjustable, interfitting structure and appropriate locking mechanism, including arrangements allowing pivoting attachment of the carrier 131 to the frame 133. Any structure may be used provided that it provides for securely and, preferably, repeatably attaching the carrier 131 to the frame 133 in a range of locations or in multiple locations, including more or less than three locations.

Furthermore, a wheel need not be the only structure used for contact with the abrasive stone or other reference surface. A low friction pad, a rail system, or another appropriate guiding system could all be used all be suitable.

The angular position of the blade or chisel being honed in the blade carrier portion of the honing guide of this invention can be modified by placing the blade or chisel between an opposed pair of matching wedges within the blade clamping structure. FIGS. 22-31 illustrate use of such wedges 200 with the guide 20 and bevel setting jig 30 of this invention, but such wedges 200 could be used with other honing guides.

Wedges 200 are shown installed in guide 20 in FIGS. 24-27, but their structure and installation can be best understood by reference to FIGS. 28-31. Each wedge 200 is an elongated body having a wedge-shaped cross section with an included angle of approximately 16° (other included angles are also usable). One end of the wedge 200 has an open slot 202 that receives one stud 38 attached to bar 34, and the other end has an L-shaped recess that receives the other stud 38 of bar 34. A bent leaf spring 206 attaches to wedge 200 adjacent to and extends into recess 204 so that (as is well illustrated by FIGS. 30 and 31) positioning wedge 200 on bar 34 causes depression of spring 206 by the stud 38 received in that recess 204 securing the wedge 200 in position and resisting its dislocation. As will be appreciated by reference to the Figures, securing a blade (e.g., blade 208 in FIGS. 24 and 25) will exert pressure on the wedges 200 causing it to tend to slide relative to and out of the carrier 34 or beam 28. The location of protrusions 210 and 212 on the narrower side of the structure of wedge 200 so that they contact studs 38 prevents wedge 200 from being dislocated.

Alternative end structures could be used on wedges 200 for positioning and retaining them on the honing guide. For instance, the ends of the wedges 200 could be penetrated by round holes for receiving the studs 38. Assembly of such wedges 200 and the honing guide would require removal of the bar 34 from the guide to position the wedges on the studs.

A recess 214 in the faces of the wedge 200 ensures that the blade or honing guide structure as may be the case contacts the wedge near its edges. Similar recesses 216 may be used in the face of the bar 34.

The invention claimed is:

1. A tool honing guide and bevel setting jig for honing a tool, comprising:

a guide comprising a tool holder and a roller, and a jig for removable coupling to the guide to facilitate positioning the tool in the guide to form a bevel at a predetermined angle, wherein the tool has a cutting arris defined by a bevel and a reference surface, wherein the guide has a reference surface for contact with the tool, and wherein the tool is positioned within the guide with contact between the tool reference surface and the guide reference surface, wherein the tool is secured in the guide by drawing a tool securing bar toward the guide reference surface to capture the tool between the bar and the guide reference surface and wherein at least a central portion of the bar has a generally triangular cross sectional shape.

2. The tool honing guide and bevel setting jig of claim 1, wherein the jig has at least one positioning surface for contact with a side of a tool during positioning of the tool in the jig.

3. The tool honing guide and bevel setting jig of claim 1, wherein the jig is adapted to be coupled to the guide in multiple positions, and further comprising indicia on at least one of the guide or jig to facilitate desirable positioning of the jig when coupling the jig to the guide so that the tool will be desirably positioned in the guide.

4. The tool honing guide and bevel setting jig of claim 1, further comprising a mechanism for positioning the roller in at least two locations relative to the tool holder to facilitate formation on a tool of a primary bevel with the roller in one of the at least two locations and a micro bevel with the roller in another of the at least two locations.

5. A tool honing guide and bevel setting jig for honing a tool, comprising:

a guide comprising a tool holder and a roller, and a jig for removable coupling to the guide to facilitate positioning the tool in the guide to form a bevel at a predetermined angle, wherein the jig is releasably attachable to the guide by clamping the jig against a dovetail structure on the guide.

6. A tool honing guide for a tool having a cutting arris defined by a bevel and a reference surface, the guide comprising:

(a) a guide body having a reference surface for contact with the tool reference surface, (b) structure accessible above the tool reference surface for securing the tool within the guide body, wherein the tool is secured in the guide by drawing a tool securing bar toward the guide reference surface to capture the tool between the bar and the guide reference surface, and (c) a roller mounted on the guide body for contact with an abrasive surface, wherein the shape of the bar swells from relatively constant thickness proximate two bar ends to a central portion having a generally triangular cross sectional shape.

7. The tool honing guide of claim 6, wherein the bar is secured to the guide body with one thumb nut threaded onto each of two studs protruding from the bar and passing through two holes in the guide body.

8. The tool honing guide of claim 6, further comprising structure attached to the guide to facilitate establishing projection of the tool from the guide.

9. The tool honing guide of claim 8, wherein the facilitating structure comprises a repositionable stop.

10. The tool honing guide of claim 6, further comprising a mechanism for positioning the roller in at least two locations relative to the tool holder to facilitate formation on a tool of a primary bevel with the roller in one of the at least two locations and a micro bevel with the roller in another of the at least two locations.

11. The tool honing guide claim 10, wherein the mechanism positions the roller in the at least two locations by moving the position of an axle on which the roller rotates.

12. The tool honing guide of claim 6, further comprising two arcuate arms attaching the guide reference surface and tool securing structure to a roller holding structure.

13. The honing guide of claim 6, wherein the roller is mounted eccentrically on a shaft, the roller having a plurality of predetermined orienting stations thereon, and shaft orienting structure mounted on the guide body for engaging selected ones of the orienting stations to select a variation in attitude of the tool.

14. The honing guide of claim 13, further comprising locking structure to maintain the shaft orienting structure in engagement with the selected orienting station.

15. The honing guide of claim 14, wherein the locking structure comprises a spring and the shaft orienting structure and the orienting stations comprise mating detents and projections.

16. The tool honing guide and bevel setting jig of claim 5, wherein the jig has at least one positioning surface for contact with a side of a tool during positioning of the tool in the jig.

17. The tool honing guide and bevel setting jig of claim 5, wherein the jig is adapted to be coupled to the guide in multiple positions, and further comprising indicia on at least one of the guide or jig to facilitate desirable positioning of the jig when coupling the jig to the guide so that the tool will be desirably positioned in the guide.

18. The tool honing guide and bevel setting jig of claim 5, further comprising a mechanism for positioning the roller in at least two locations relative to the tool holder to facilitate formation on a tool of a primary bevel with the roller in one of the at least two locations and a micro bevel with the roller in another of the at least two locations.

19. The tool honing guide of claim 1, wherein the bar is secured to the guide body with one thumb nut threaded onto each of two studs protruding from the bar and passing through two holes in the guide body.

20. The tool honing guide of claim 1, further comprising structure attached to the guide to facilitate establishing projection of the tool from the guide.

21. The tool honing guide of claim 20, wherein the facilitating structure comprises a repositionable stop.

22. The tool honing guide of claim 5, further comprising structure attached to the guide to facilitate establishing projection of the tool from the guide.

23. The tool honing guide of claim 22, wherein the facilitating structure comprises a repositionable stop.

24. The tool honing guide claim 4, wherein the mechanism positions the roller in the at least two locations by moving the position of an axle on which the roller rotates.

25. The tool honing guide claim 18, wherein the mechanism positions the roller in the at least two locations by moving the position of an axle on which the roller rotates.

26. The honing guide of claim 1, wherein the roller is mounted eccentrically on a shaft, the roller having a plurality of predetermined orienting stations thereon, and shaft orienting structure mounted on the guide body for engaging selected ones of the orienting stations to select a variation in attitude of the tool.

27. The honing guide of claim 26, further comprising locking structure to maintain the shaft orienting structure in engagement with the selected orienting station.

28. The honing guide of claim 27, wherein the locking structure comprises a spring and the shaft orienting structure and the orienting stations comprise mating detents and projections.

29. The honing guide of claim 5, wherein the roller is mounted eccentrically on a shaft, the roller having a plurality of predetermined orienting stations thereon, and shaft orienting structure mounted on the guide body for engaging selected ones of the orienting stations to select a variation in attitude of the tool.

30. The honing guide of claim 29, further comprising locking structure to maintain the shaft orienting structure in engagement with the selected orienting station.

31. The honing guide of claim 30, wherein the locking structure comprises a spring and the shaft orienting structure and the orienting stations comprise mating detents and projections.

* * * * *